US008920074B2

(12) United States Patent
Graham et al.

(10) Patent No.: US 8,920,074 B2
(45) Date of Patent: Dec. 30, 2014

(54) UNDERGROUND MINING APPARATUS

(75) Inventors: Neil Deryck Bray Graham, Canning Vale (AU); Arthur Derrick Bray Graham, Mosman Park (AU)

(73) Assignees: Z-Filter Pty Ltd., Western Australia (AU); Gladius Mining Pty Ltd., Perth, Western Australia (AU); Neil Deryck Bray Graham, Coogee, Western Australia (AU)

( * ) Notice: Subject to any disclaimer, the term of this patent is extended or adjusted under 35 U.S.C. 154(b) by 1283 days.

(21) Appl. No.: 12/377,725

(22) PCT Filed: Aug. 14, 2007

(86) PCT No.: PCT/AU2007/001148

§ 371 (c)(1),
(2), (4) Date: Jul. 1, 2010

(87) PCT Pub. No.: WO2008/019433

PCT Pub. Date: Feb. 21, 2008

(65) Prior Publication Data

US 2010/0284748 A1 Nov. 11, 2010

(30) Foreign Application Priority Data

Aug. 14, 2006 (AU) ..... 2006904403

(51) Int. Cl.

| | |
|---|---|
| ***E21D 11/00*** | (2006.01) |
| ***E21C 27/14*** | (2006.01) |
| ***E21C 25/58*** | (2006.01) |
| ***E21C 41/16*** | (2006.01) |
| ***E21C 25/00*** | (2006.01) |
| ***E21D 19/04*** | (2006.01) |
| ***E21D 9/04*** | (2006.01) |
| ***E21D 9/12*** | (2006.01) |

(52) U.S. Cl.
CPC *E21D 19/04* (2013.01); *E21D 9/04* (2013.01); *E21D 9/12* (2013.01)
USPC ..... 405/146; 405/150.1; 405/151

(58) Field of Classification Search
CPC ..... E21D 11/00; E21D 9/1093; E21D 13/00; E21C 27/24; E21C 25/58; E21C 41/16; E21C 25/00
USPC ..... 299/30, 33, 64, 67, 68, 77, 78; 405/146, 405/150.1, 151
See application file for complete search history.

(56) References Cited

U.S. PATENT DOCUMENTS 1,006,799 A * 10/1911 Scholtz ..... 405/150.1
1,140,673 A * 5/1915 Giggey ..... 299/31

(Continued)

FOREIGN PATENT DOCUMENTS

DE 3425294 A1 * 1/1986 ..... E21D 9/10
DE 3819658 A1 * 12/1989 ..... E21D 11/40

(Continued)

OTHER PUBLICATIONS

International Preliminary Report on Patentability; PCT/AU2007/001148; Feb. 17, 2009.

(Continued)

*Primary Examiner* — John Kreck
*Assistant Examiner* — Edwin Toledo-Duran
(74) *Attorney, Agent, or Firm* — Peter J. Meza; Hogan Lovells US LLP

(57) ABSTRACT

An underground mining apparatus includes a mining head for moving through underground material to extract material in its path and form a passageway behind the mining head as it advances. An elongate structure extends along the passageway to the mining head and provides a path for delivering the extracted material to ground surface. A shroud is positioned about the elongate structure for supporting engagement with the periphery of the passageway and to provide a space through which the elongate structure can move. The shroud has a cross-sectional shape corresponding generally to the cross-sectional shape of the passageway formed by the mining head. A method is also disclosed.

22 Claims, 42 Drawing Sheets

(56) References Cited

U.S. PATENT DOCUMENTS

| | | | | | |
|---|---|---|---|---|---|
| 1,276,706 | A | * | 8/1918 | Aydelotte | 102/362 |
| 1,292,159 | A | * | 1/1919 | Trumpout | 405/146 |
| 1,361,996 | A | * | 12/1920 | Hirst | 299/64 |
| 1,751,147 | A | * | 3/1930 | Hackley | 249/1 |
| 1,880,091 | A | * | 9/1932 | Hughes | 299/67 |
| 1,903,866 | A | * | 4/1933 | Lacaprara et al. | 405/150.1 |
| 1,960,394 | A | * | 5/1934 | Parker | 299/33 |
| 2,067,493 | A | * | 1/1937 | Kinzie | 405/146 |
| 2,067,711 | A | * | 1/1937 | Killmer | 405/151 |
| 2,077,137 | A | * | 4/1937 | Wilkoff | 405/151 |
| 2,148,783 | A | * | 2/1939 | Spaulding | 405/147 |
| 2,385,251 | A | * | 9/1945 | Ayers | 405/146 |
| 2,798,714 | A | * | 7/1957 | Russell | 299/64 |
| 2,995,901 | A | * | 8/1961 | Kemper | 405/150.1 |
| 3,108,788 | A | * | 10/1963 | Allimann | 299/57 |
| 3,301,600 | A | * | 1/1967 | Bland et al. | 299/33 |
| 3,325,217 | A | * | 6/1967 | Enz | 299/31 |
| 3,350,889 | A | * | 11/1967 | Sturm | 405/143 |
| 3,355,215 | A | * | 11/1967 | Wallers et al. | 299/60 |
| 3,378,305 | A | * | 4/1968 | Geldmacher et al. | 299/33 |
| 3,413,033 | A | * | 11/1968 | Clark | 299/33 |
| 3,459,452 | A | * | 8/1969 | Schnabel, Jr. | 299/31 |
| 3,480,327 | A | * | 11/1969 | Kunijiro | 299/33 |
| 3,508,317 | A | * | 4/1970 | Hill et al. | 405/150.1 |
| 3,510,170 | A | * | 5/1970 | Wilms | 299/33 |
| 3,523,426 | A | * | 8/1970 | Lauber | 405/145 |
| 3,556,599 | A | * | 1/1971 | Fikse | 299/11 |
| 3,603,100 | A | * | 9/1971 | Cowley | 405/138 |
| 3,767,263 | A | * | 10/1973 | Gootee | 299/33 |
| 3,861,750 | A | * | 1/1975 | Follert et al. | 299/33 |
| 3,885,832 | A | * | 5/1975 | Altseimer et al. | 299/14 |
| 3,966,256 | A | * | 6/1976 | Fikse | 299/33 |
| 3,967,463 | A | * | 7/1976 | Grandori | 405/141 |
| 3,972,200 | A | | 8/1976 | Scarpi | |
| 3,982,340 | A | * | 9/1976 | Satterwhite | 37/190 |
| 4,099,785 | A | * | 7/1978 | Groetschel | 299/11 |
| 4,122,682 | A | * | 10/1978 | Groetschel | 405/302.3 |
| 4,226,476 | A | * | 10/1980 | Fairchild et al. | 299/31 |
| 4,379,660 | A | * | 4/1983 | Groetschel | 405/288 |
| 4,420,188 | A | * | 12/1983 | Robbins et al. | 299/31 |
| 4,486,050 | A | * | 12/1984 | Snyder | 299/18 |
| 4,494,799 | A | * | 1/1985 | Snyder | 299/31 |
| 4,637,657 | A | * | 1/1987 | Snyder | 299/31 |
| 4,668,016 | A | * | 5/1987 | Hart | 299/29 |
| 4,753,484 | A | * | 6/1988 | Stolarczyk et al. | 299/1.1 |
| 4,769,192 | A | * | 9/1988 | Cerutti | 264/33 |
| 4,790,395 | A | * | 12/1988 | Gack et al. | 175/102 |
| 4,834,580 | A | * | 5/1989 | Barendsen et al. | 405/138 |
| 4,892,441 | A | * | 1/1990 | Riker | 405/146 |
| 4,915,453 | A | * | 4/1990 | Fikse | 299/31 |
| 4,960,306 | A | * | 10/1990 | Kipp et al. | 299/41.1 |
| 5,072,994 | A | * | 12/1991 | Brandl et al. | 299/67 |
| 5,076,729 | A | | 12/1991 | Grotenhofer | |
| 5,169,264 | A | * | 12/1992 | Kimura | 405/184 |
| 5,171,105 | A | | 12/1992 | Grotenhofer | |
| 5,340,199 | A | * | 8/1994 | Piefenbrink et al. | 299/10 |
| 5,803,666 | A | * | 9/1998 | Keller | 405/146 |
| 5,816,750 | A | * | 10/1998 | Steffenino | 405/302.3 |
| 6,109,828 | A | * | 8/2000 | Keller | 405/146 |
| 6,199,591 | B1 | * | 3/2001 | Kiest et al. | 138/98 |
| 6,220,670 | B1 | * | 4/2001 | Mraz | 299/18 |
| 6,298,920 | B1 | * | 10/2001 | Keller | 166/377 |
| 6,328,501 | B1 | * | 12/2001 | Gimbert | 405/135 |
| 6,467,136 | B1 | | 10/2002 | Graham | |
| 6,484,757 | B1 | * | 11/2002 | Warren | 138/98 |
| 6,533,500 | B1 | * | 3/2003 | Jacobsen et al. | 405/150.1 |
| 6,554,368 | B2 | * | 4/2003 | Drake et al. | 299/8 |
| 6,644,753 | B2 | * | 11/2003 | Mraz | 299/1.4 |
| 6,679,293 | B2 | * | 1/2004 | Driver | 138/98 |
| 6,698,843 | B2 | * | 3/2004 | Mraz | 299/18 |
| 6,869,147 | B2 | * | 3/2005 | Drake et al. | 299/8 |
| 6,953,307 | B2 | * | 10/2005 | Graham | 405/184.1 |
| 7,387,174 | B2 | * | 6/2008 | Lurie | 175/57 |
| 7,448,413 | B2 | * | 11/2008 | Kiest, Jr. | 138/98 |
| 7,517,212 | B2 | * | 4/2009 | Blackmore et al. | 425/460 |
| 8,141,647 | B2 | * | 3/2012 | Kriesels et al. | 166/380 |
| 8,387,709 | B2 | * | 3/2013 | Kriesels | 166/384 |
| 8,567,491 | B2 | * | 10/2013 | Lurie | 166/107 |
| 2003/0151297 | A1 | * | 8/2003 | Graham | 299/8 |
| 2003/0159776 | A1 | * | 8/2003 | Graham | 156/293 |
| 2005/0179307 | A1 | | 8/2005 | Graham | |
| 2007/0084555 | A1 | * | 4/2007 | Graham | 156/293 |
| 2010/0314931 | A1 | * | 12/2010 | Ebner et al. | 299/33 |
| 2011/0129300 | A1 | * | 6/2011 | Dimillo | 405/152 |

FOREIGN PATENT DOCUMENTS

| | | | | | |
|---|---|---|---|---|---|
| GB | 2179982 | A | * | 3/1987 | E21C 27/24 |
| GB | 2185509 | A | * | 7/1987 | E21C 27/24 |
| JP | 01203594 | A | * | 8/1989 | E21D 9/08 |
| JP | 03235899 | A | * | 10/1991 | E21D 11/10 |
| JP | 11101087 | A | * | 4/1999 | E21D 9/06 |
| JP | 11256983 | A | * | 9/1999 | E21D 9/06 |
| JP | 2000154694 | A | * | 6/2000 | E21D 9/06 |
| JP | 2002122000 | A | * | 4/2002 | E21D 11/14 |
| JP | 2003049597 | A | * | 2/2003 | E21D 11/00 |
| WO | WO 9611324 | A1 | * | 4/1996 | |
| WO | WO 0177492 | A1 | * | 10/2001 | |
| WO | WO 02/077512 | | | 10/2002 | |
| WO | WO 2005024178 | A1 | * | 3/2005 | |

OTHER PUBLICATIONS

International Search Report; PCT/AU2007/001148; Sep. 12, 2007.

Hassan Z. Harraz, Underground Mining: A short series of lectures prepared for the Fourth year of Geology, Tanta University, Nov. 2011, slides 28-31.

F.G. Bell, 2007, Engineering Geology, p. 500, http://books.google.com.au/books?id=lzm6IUVDBcUC&pg=PA485&lpg=PA485&dq=bridging+in+tunnels&source=bl&ots=klSwA6_PEO&sig=Wz7eOnRTBR37paxiOq0NhTGJ6Q0&hl=en&sa=X&ei=zQkDUuCLJufNiAeB_IHYCw&ved=0CDAQ6AEwATgK#v=onepage&q=bridging%20in%20tunnels&f=false.

David George Price, Edited and Compiled by M.H. de Freitas, Engineering Geology: Principles and Practice, 2009 Springer, ISBN: 978-3-540-29249-4, pp. 144-146 and 291-294.

Hassan Z. Harraz, Underground Mining: A short series of lectures prepared for the Fourth year of Geology, Tanta University, Nov. 2011, 4 pgs.

Thomas Tredgold, article on Shoring and Strutting from http://chestofbooks.com/home-improvement/woodworking/Carpentry-Principles/Shoring-And-Strutting-Continued.html taken from the book "Elementary Principles Carpentry", pp. 1-5, published in 1875.

* cited by examiner

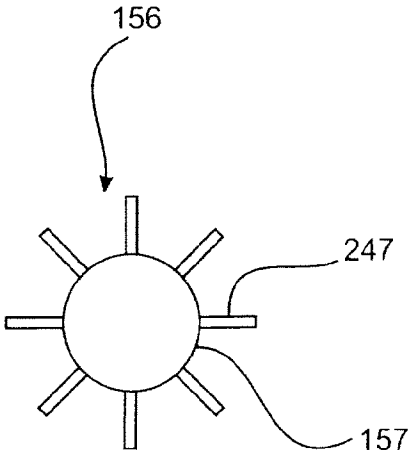
Fig. 42
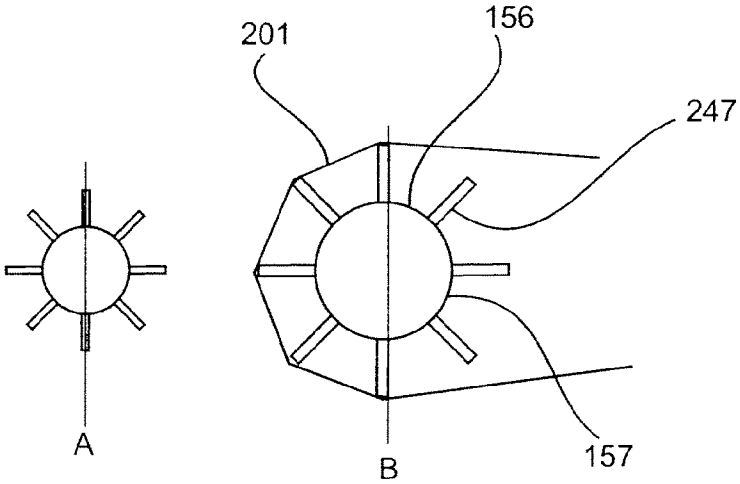
Fig. 41
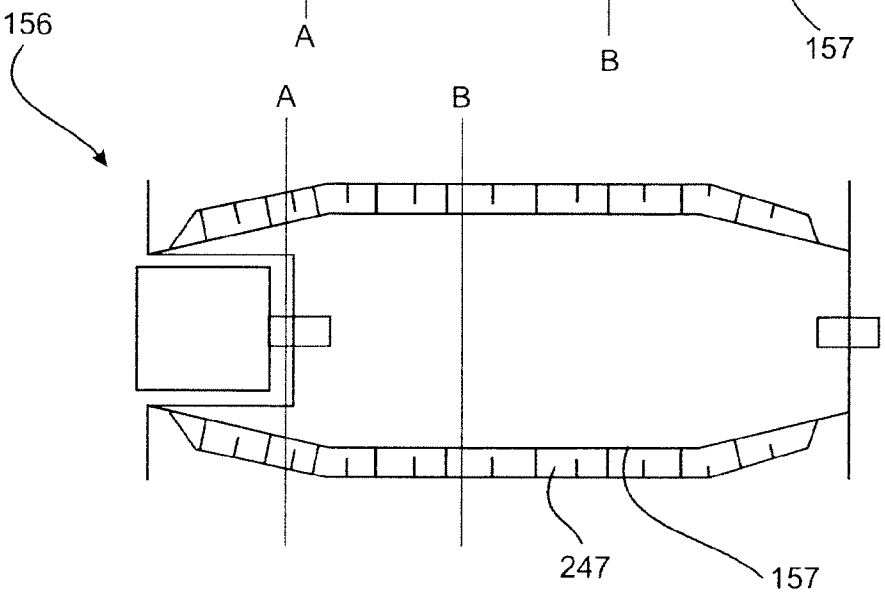

UNDERGROUND MINING APPARATUS

RELATED APPLICATIONS

The present application is a U.S. national filing under 35 U.S.C. §371 of PCT/AU2007/001148 filed Aug. 14, 2007, and claims priority of Australia Patent Application No. 2006904403 filed Aug. 14, 2006, both of which applications are incorporated in their entireties hereby by this reference.

FIELD OF THE INVENTION

This invention relates to an apparatus and method for working underground. More particularly, the invention is concerned with apparatus for movement along an underground passage which is formed and which is also supportingly lined against collapsing by the apparatus itself. The invention also relates to an apparatus and method for extracting material from an underground location.

The invention has been devised particularly, although not necessarily solely, for use in underground mining operations involving extraction of target material underground and delivery of the extracted material to a location (typically at ground level) for processing.

BACKGROUND ART

In international application PCT/AU95/00667 there is disclosed an arrangement for lining a passageway created by a mining head as it advances through an underground formation. The mining head excavates material as it advances, thereby creating the passageway. The excavated material is conveyed to ground surface by a pipe string extending along the passageway from the mining head. The pipe string is also utilised to deliver services required by the mining head during performance of the mining operation. The pipe string progressively enters the passageway and advances therealong with the mining head. It also retreats with the mining head. Because the pipe string moves within the passageway, it is important that the passageway does not collapse upon the pipe string. The passageway is therefore progressively lined as it is created. The lining is by way of a shroud which is assembled and inflated to provide a generally cylindrical load-bearing liner.

The lining arrangement is particularly suitable for use with a mining head of the type disclosed in international application PCT/AU96/00106. Such a mining head, however, presents a generally rectangular front profile and so the passageway that it excavates is correspondingly rectangular in cross-section. Thus, there is disconformity between the generally rectangular cross-sectional shape of the passageway and the generally circular cross-sectional shape of the liner. This provides a vacant space between the periphery of the passageway and the periphery of the liner into which some of the material bounding the passageway can collapse.

Further, material which has collapsed into the space about the liner behind the mining head must be extracted in order for the mining head to be reversed. This can be done by extracting the collapsed material from the region behind the mining head and delivering it to the region in front of the mining head, thus continually providing space behind the mining head into which the mining head can reverse. One way of extracting the collapsed material behind the mining head and delivering it to the region in front of the mining head is to pump the material through the mining head, as disclosed in international application PCT/AU96/00106. This requires a pumping system within the mining head, which adds to the cost and complexity of the mining head and also occupies space within the mining head which could otherwise be used for other purposes. It is against this background that the present invention has been developed.

The above discussion of the background to the invention is intended to facilitate an understanding of the present invention. However, it should be appreciated that the discussion is not an acknowledgement or admission that any of the material referred to was published, known or part of the common general knowledge in Australia as at the priority date of the application.

SUMMARY OF THE INVENTION

According to a first aspect of the invention there is provided an underground working apparatus comprising a working head for moving through underground material and forming a passageway behind the working head as it advances through the material, an elongate structure extending along the passageway to the working head, and means for positioning a shroud about at least a portion of the longitudinal periphery of the elongate structure for supporting engagement with the periphery of the passageway to provide a space through which the elongate structure can move, the shroud having a cross-sectional shape corresponding generally to the cross-sectional shape of the passageway formed by the working head.

Preferably, an inflation fluid is introduced into the region between the shroud and the elongate structure for inflating the shroud and maintaining it in supporting engagement with the periphery of the passageway.

Typically, the passageway formed by the working head is generally rectangular, in which case the shroud cross-section is also generally rectangular.

Preferably, the shroud is assembled from a plurality of longitudinal shroud sections adapted to be connected one to another at adjacent longitudinal edges.

Preferably, the connection is a sealing connection in the sense that it is fluid-tight.

The connection may be provided by complementary connector elements provided at the longitudinal edges of the shroud sections.

Preferably, each shroud section is pliant and comprises a length of flexible material.

Each shroud section may comprise at least one funicular element (such as a cable or rope) to provide longitudinal tensile strength. Typically, each shroud section comprises two funicular elements extending along the longitudinal marginal peripheries of the shroud section.

Preferably, the connector elements are anchored to the funicular elements.

Preferably, there is one shroud section corresponding to each side of the passageway. Typically, the passageway is of generally rectangular cross-section having four sides, in which case there would be four shroud sections. Other cross-sectional shapes of passageway are of course possible.

In assembly of the shroud, the shroud sections are preferably each turned around a turning location to provide an inner portion which is moved along the passageway with the elongate structure, and an outer portion which is turned back with respect to the inner portion and which is assembled into the shroud.

For this purpose, the turning location is preferably defined by a turn structure. Preferably the turn structure is rotatable about an axis transverse to the longitudinal extent of the shroud section.

Preferably, the inner portion of each shroud section assumes a laterally compacted condition in order that it may be accommodated in and moved along the space which is within the shroud and in which the elongate structure is also accommodated.

Conveniently, each inner portion incorporates longitudinal folds to provide the laterally compact condition. It is necessary to move each shroud section from the laterally compact condition occupied by the inner portion into a laterally extended taut condition at the outer portion so that the assembled shroud can supportingly engage the periphery of the passageway.

Preferably, movement of each shroud section between the laterally compact condition and the laterally extended condition involves movement through an intermediate taut condition at or after the turning location.

In one form of the invention, the turn structure may have a tortuous profile for contact with the shroud section turning therearound. With its tortuous profile, the turn structure causes that part of the shroud section in contact therewith to assume the taut condition in which any wrinkles or creases are removed and from which it can spread to the fully extended condition as it moves away from the turn structure during assembly of the shroud. Because of the tortuous profile of the turn structure, the spacing between two opposed ends of that part of the shroud section in contact with the turn structure is considerably less than the actual width of the shroud material therebetween. It is because of this arrangement that that part of the shroud structure in contact with the turn structure is caused to assume the taut condition.

In one arrangement, the turn structure may comprise a plurality of rotatable elements each mounted for rotation about an axis transverse to the direction of travel of the shroud section around the turn structure.

Preferably, at least some of the rotatable elements are spaced one with respect to the other laterally with respect to the direction of travel of the shroud section.

Preferably, the rotatable elements are each configured as a disc having two opposed broad surfaces and a peripheral edge surface therebetween.

Preferably, each disc is so mounted that its central axis defines the axis of rotation. In this way, the edge surface of each disc is presented to the oncoming shroud section.

Preferably, each disc is of lenticular configuration, whereby the opposed broad surfaces are each convex.

Preferably, the discs are mounted for rotation on a common base itself rotatable about an axis transverse to the direction of travel of the shroud section.

With this arrangement, the turn structure comprises a roller assembly composed of the common base and the rotatable elements mounted thereon.

Preferably, the common base is of generally symmetrical configuration to present a cylindrical side surface.

Preferably, the cylindrical side surface comprises a right cylindrical central portion and two inwardly tapering end portions of frusto-conical configuration.

Preferably, the base incorporates recesses for accommodating the rotatable discs, with a portion of each disc projecting beyond the cylindrical side surface of the base for presentation to the oncoming shroud section.

With this arrangement, the tortuous profile presented to the oncoming shroud section comprises the various intervening sections of the cylindrical side surface between adjacent discs, as well as the edge surface and the exposed sections of the opposed broad surfaces of each disc.

In another arrangement, the turn structure may comprise a structure adapted to deform upon contact by shroud section to cause that part of the shroud section in contact therewith to assume the taut condition. The structure may comprise a deformable structure arranged to present a profile for contact with the shroud section. The deformable structure may comprise deformable elements (such as bristles or vanes) mounted on a rotatable base. The rotatable base may comprise a rigid base or a flexible base.

In another form of the invention, the turn structure comprises two wheels each having an outer periphery configured to guidingly receive a respective one of the two funicular elements.

The elongate structure extending from the working head may comprise a plurality of elongate elements bundled together. The elongate elements may include cabling and conduits. The cabling may comprise electrical cabling, data communications cabling and other service lines, and the conduits may comprise piping for slurry and water.

The elongate elements may be bundled together in a sock structure. The sock structure preferably includes an inner wall which defines the sleeve within which the bundle of elongate elements are encapsulated, and an outer wall spaced from the inner wall to define a chamber within which the shroud sections are accommodated as they move along the passageway.

Preferably, the chamber is divided into a plurality of sub-chambers (one corresponding to each shroud section) by partition walls extending between the inner and outer walls.

As previously mentioned an inflation fluid is provided for inflating the shroud and maintaining it in supporting engagement with the periphery of the passageway.

A further inflation fluid is also preferably introduced into the chamber (or more particularly the various sub-chambers in circumstances where the chamber is divided into sub-chambers) for inflating the chamber (or the various sub-chambers).

The inflation pressure within the chamber (or various sub-chambers) is marginally higher than the inflation pressure within the shroud to which the exterior of the sock structure is exposed. This ensures that the chamber (or the various sub-chambers) remains in an inflated condition.

The inflation pressure in the chamber (or various sub-chambers) acts upon the inner wall defining the sleeve and so serves to urge the sleeve into a tightly wrapped condition about the bundle of elongate elements.

Preferably, the inflation fluid in each case comprises a liquid, conveniently water.

In this way, the shroud sections have some buoyancy and can be "floated" along the inflation chamber (or various sub chambers).

The sleeve, which tightly envelopes about the bundle of elongate elements, isolates the shroud sections from the elongate elements thereby avoiding entanglement.

Preferably, the sock structure is progressively fitted onto the elongate structure (i.e. the bundle of elongate elements) as the latter is progressively introduced into the passageway, typically at a handling station which may be at ground level or in a recess or launch pit within the ground.

In fitting the sock structure onto the elongate structure, the inner wall may be progressively wrapped around the elongate structure and then closed upon itself so as to progressively encapsulate the elongate structure. The inner wall may be closed upon itself in any suitable way, such as by a zipper arrangement. It is preferred that the inner wall be sealingly enclosed upon itself in a fluid-tight manner.

Similarly, the outer wall may be progressively closed about the shroud sections as they are progressively introduced into the chamber. The outer wall may be closed in any suitable way such as zipper arrangements associated with the various sub chambers. It is preferred that the outer wall is sealingly closed in a fluid-tight manner.

The sock structure may be stored in roll form (typically at or near ground surface) and unwound from the roll and progressively delivered to the elongate structure.

Pipes forming part of the bundle of elongate elements may comprise a plurality of pipe sections which are connected one to another at the handling station. Other elongate elements in the bundle (such as cables) may be stored in roll form, and unwound from the roll and progressively delivered to the elongate structure as it advances into the passageway.

Similarly, the shroud sections may be stored in roll form, and unwound from the roll and progressively delivered to the elongate structure as it advances into the passageway.

The working head may comprise a mining head which progressively evacuates material from the underground location at which it is operating and conveys the excavated material to a remote location (such as the handling station) by way of piping in the elongate structure. The path of the mining head provides the passageway along which the elongate structure and shroud extends during the excavating operation.

The mining head may comprise a body structure incorporating a casing having an exterior presenting a generally rectangular profile to oncoming material as it advances through the underground location. The exterior may include a front wall, a top wall, a bottom wall and two side walls. The body structure also includes a rear section which forms part of the means for positioning the shroud about at least a portion of the longitudinal periphery of the elongate structure.

A suction chamber is preferably accommodated in the body structure to receive slurry material extracted from the underground location. The suction chamber may incorporate at least one outlet through which the slurry can be discharged.

The front wall preferably incorporates a screen through which slurry material can pass to enter the suction chamber.

The screen preferably comprises a grizzly having a first side which confronts the oncoming material and an opposed second side. The grizzly may comprise a plurality of longitudinal elements positioned in spaced apart side-by-side relationship to define gaps therebetween. The gaps provide elongate screen openings through which slurry material can pass to enter the suction chamber.

Preferably, a tine assembly is associated with the screen. The tine assembly may serves to fragment oncoming material in the path of the mining head, as well as to remove any material accumulating in the screen openings and also dislodge any over-size material such as rocks and boulders located against the screen.

The tine assembly preferably comprises a plurality of tines, each of which is movable through a respective cyclical path. A part of the cyclical path for each tine includes a respective one of the screen openings, and another part has the tine travelling within the suction chamber.

The tines are preferably carried on a support structure located adjacent the second side of the screen, and are of a length to extend through the screen and extend beyond the first side thereof when travelling along the screen openings.

Preferably, the support structure is movable through a cyclical path and includes a plurality of support elements which extend transversely in the direction of travel of the cyclical path and which carry the tines.

Preferably, the tines are moveably supported on the support elements so as to be capable of deflection upon encountering an unmanageable obstruction. In this way, the tines can deflect rearwardly upon encountering an unmanageable obstruction that can be neither moved nor fragmented. The rearward angular deflection of the tines allows them to sweep past the obstruction without damage to the tines.

Preferably, there is a tine structure defining each tine.

Each tine structure may incorporate a spring for yieldingly resisting the rearward deflection of the tine and to return the tine to its upstanding condition after it has moved clear of the obstruction.

Each tine structure may be formed from a rod of spring material, the rod being configured to have a coiled portion defining the spring, a first extension portion extending from one end of the coiled portion to define the tine and a second extension portion extending from the other end of the coiled portion. The coiled portion is received on one support element such that the tine defined by the first extension portion projects laterally from the support element and the second extension portion extends to an adjacent support element against which it acts when under load. In this way, forces induced in the spring upon angular deflection of the tine are not transmitted as torsional forces to the support element carrying the tine (which would be the case if the spring were to be anchored to the particular support element upon which the tine is carried) but rather as simply a reaction force applied to the adjacent support element.

Preferably, the outer end section of the second extension portion is connected to the adjacent support element. This may be achieved by configuring the outer end section as a hook for hooking engagement with the adjacent support element.

Preferably, the support means further comprises an endless chain adapted to move around end sprockets. More preferably, the support means comprises two endless chains moveable about respective end sockets, with the support elements carried by and extending between the two endless chains.

Preferably, a flushing system is provided for flushing the endless chain to resist ingress of grit.

Preferably, the flushing system establishes a flushing fluid flow across the chain in a direction towards the suction chamber, thereby serving to convey a grit material from slurry within the suction chamber in a direction away from the chain.

Preferably, the flushing fluid comprises water. Conveniently, the flushing water is sourced from the water supplied to the passageway as inflation fluid for the shroud.

Preferably, slurry material drawn into the suction chamber is conveyed to a pipe within the elongate structure for upward conveyance of the slurry material.

The slurry is preferably formed by agitating the mixture of solid materials and water present in the underground location at which the working operation is taking place. It may be necessary to fragment consolidated materials, and in particular clay, in the underground location in order to form the slurry and also allow the working head to move through the location.

The introduction of water, preferably at high pressure, into the underground location may also assist in formation of the slurry or indeed form the slurry in circumstances where water is not present in the underground environment.

Preferably, a zone of slurry is generated immediately ahead of the apparatus by the action of the tines. The zone of slurry may be in homeostasis, with no material entering or leaving the zone. With the movement of the tines within the zone, the tines agitate the slurry but nevertheless the state of homeostasis remains. The slurry will only move from that state when subjected to the suction effect of the apparatus. The zone of slurry presents little (if any) resistance to the advancing apparatus as long as slurry material is drawn into the apparatus as it advances. If the slurry material is not drawn from the slurry zone, it provides a barrier to advancing movement of the apparatus. Slurry material which does not enter the apparatus can pass over the apparatus as the latter advances. Once this by-passing slurry has moved out of the influence of the agitating tines, it can settle around the apparatus to be engaged by the drive system (such as the endless tracks) on the apparatus to provide traction.

The working head may also have means for disturbing the slurry in order to maintain heavy particles in suspension in the slurry. Such means may comprise means for vibrating the recovery head or at least part thereof to agitate the material to form a slurry.

A pump may be accommodated in the body structure for conveying the slurry from the working head upwardly along the pipe work.

According to a second aspect of the invention there is provided a method of working underground using apparatus according to the first aspect of the invention.

According to a third aspect of the invention there is provided a method of extracting material from an underground location using apparatus according to the first aspect of the invention.

According to a fourth aspect of the invention there is provided a method of extracting material from an underground location comprising moving a working head through the underground material and forming a passageway behind the working head as it moves through the material, providing an elongate structure extending along the passageway to the working head, and positioning a shroud about at least a portion of the longitudinal periphery of the elongate structure for supporting engagement with the periphery of the passageway to provide a space through which the elongate structure can move, the shroud having a cross-sectional shape corresponding generally to the cross-sectional shape of the passageway formed by the working head.

Preferably, the target material to be extracted is drawn into the working head and conveyed along the elongate structure to a remote location.

Preferably, the remote location is at ground level and the extracted material is processed at ground level.

BRIEF DESCRIPTION OF THE DRAWINGS

The invention will be better understood by reference to the following description of several specific embodiments, as shown in the accompanying drawings in which:

FIG. 6 is a plan view of the mining head;

FIG. 41 is a schematic elevational view of a turn structure for apparatus according to a second embodiment;

FIG. 42 is an end view of the turn structure;

FIG. 55 is a schematic cross-sectional view of a supporting shroud in position in a passageway created by the mining head, and a sock structure in which elongate elements are bundled;

BEST MODE(S) FOR CARRYING OUT THE INVENTION

Figure 1:
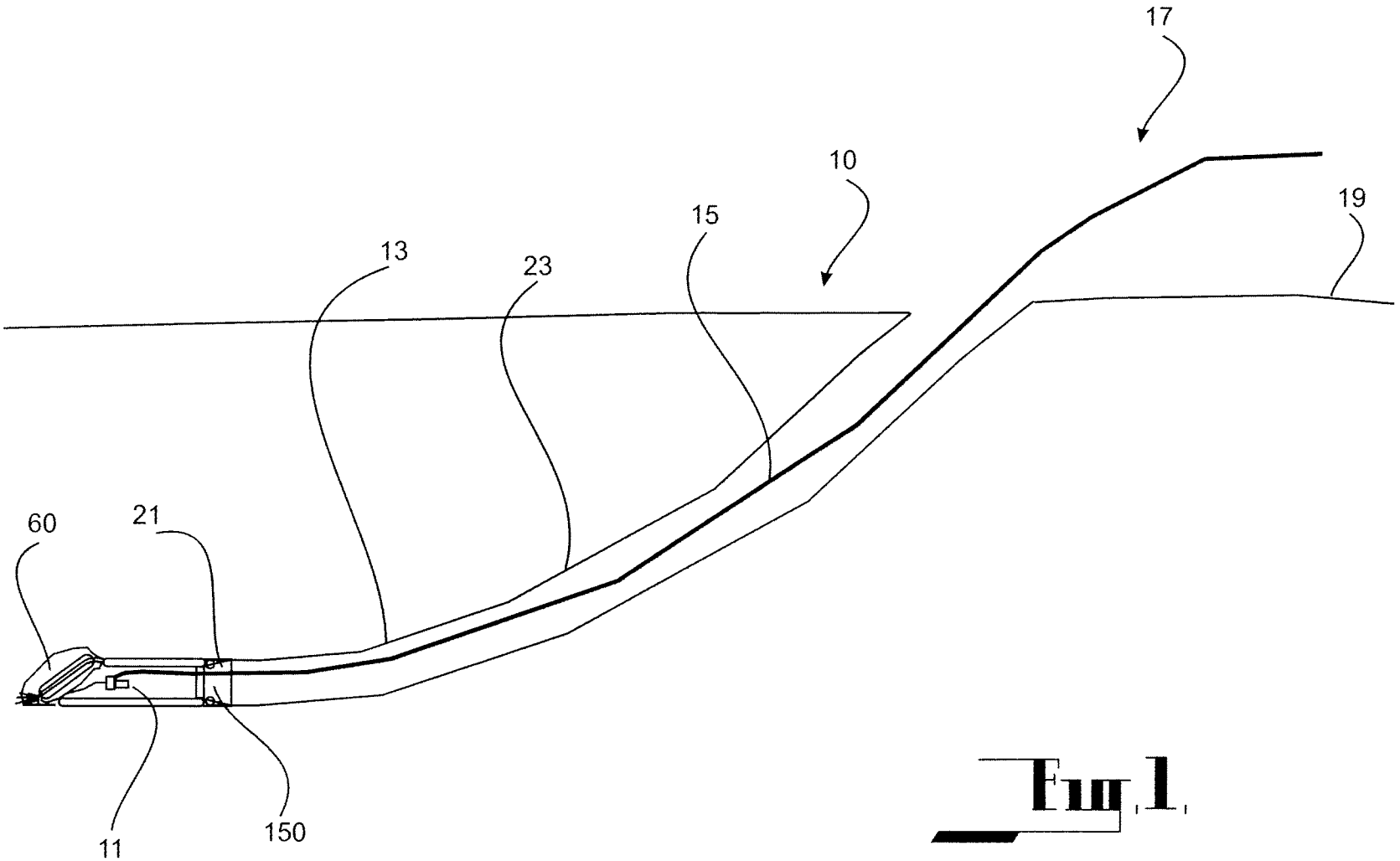
FIG. 1 is a schematic side elevational view of the apparatus according to a first embodiment in an underground mining operation.
Figure 2:
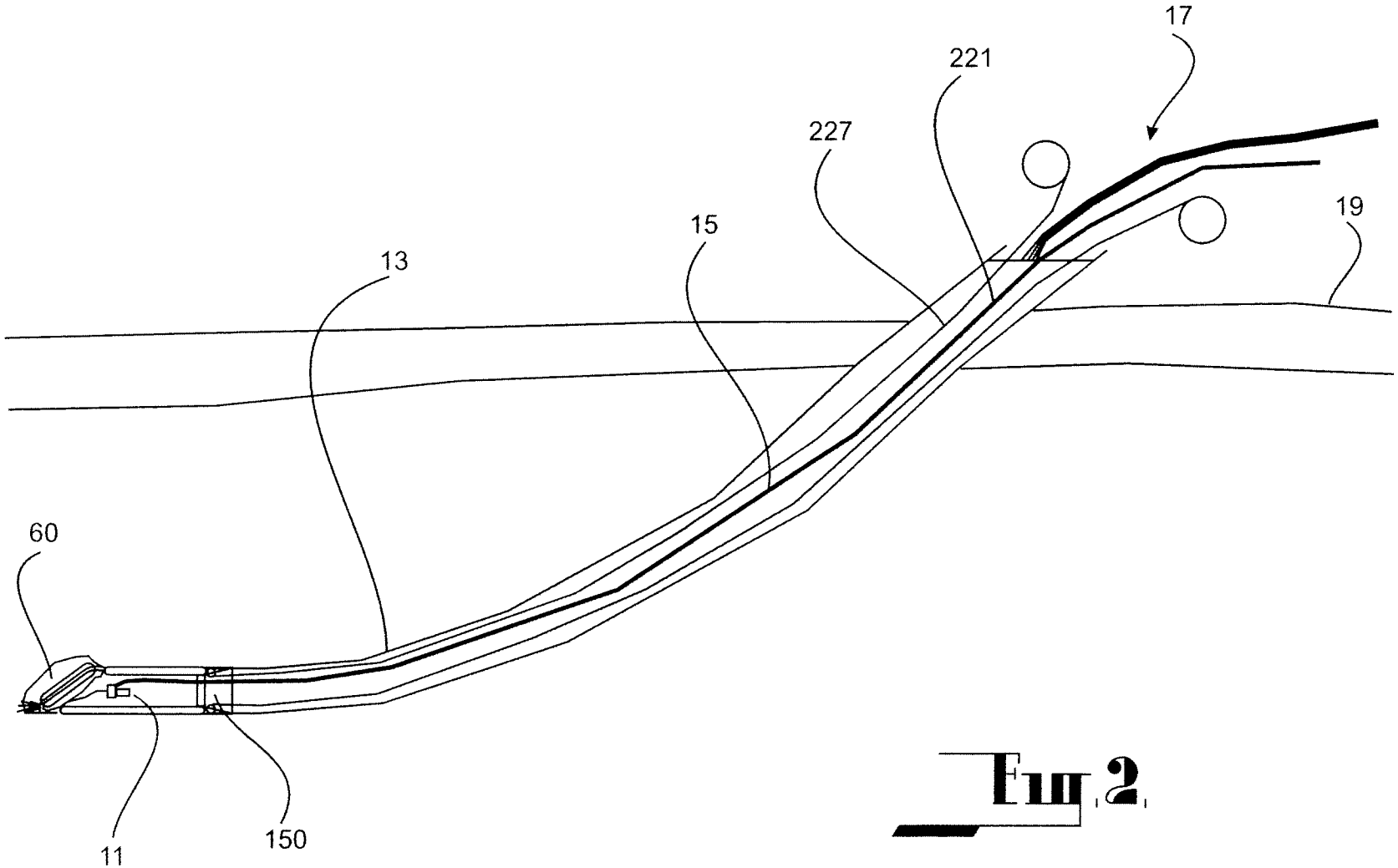
FIG. 2 is a view somewhat similar to FIG. 1 but showing other features.
Figure 3:
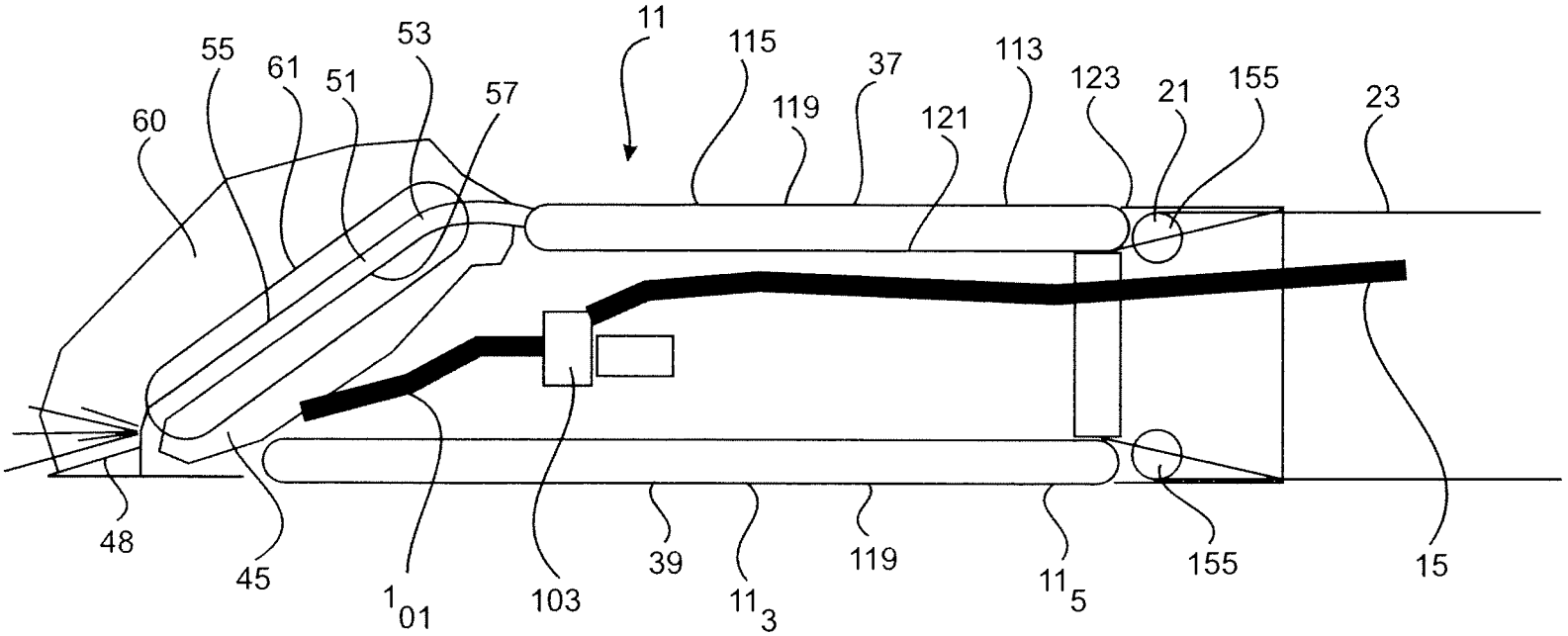
FIG. 3 is a schematic side view of the mining head forming part of the apparatus as shown in FIG. 1.
Figure 4:
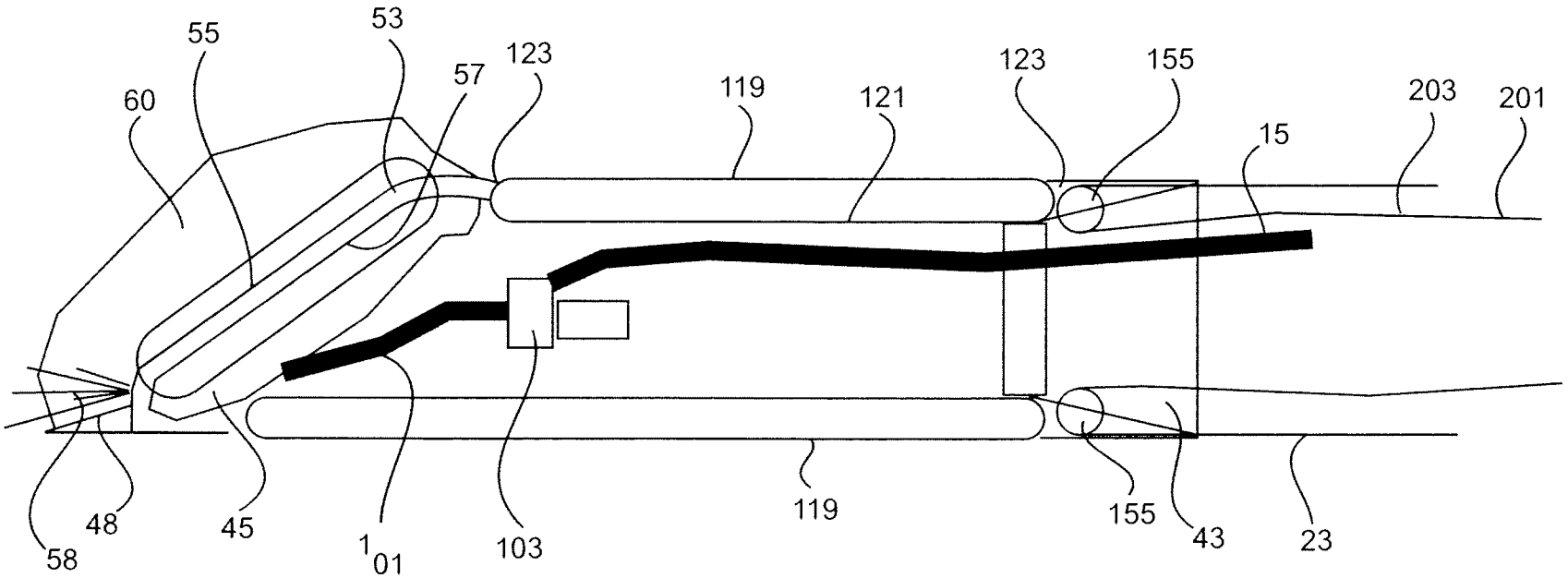
FIG. 4 is a schematic side view of the mining head as shown in FIG. 2.
Figure 5:
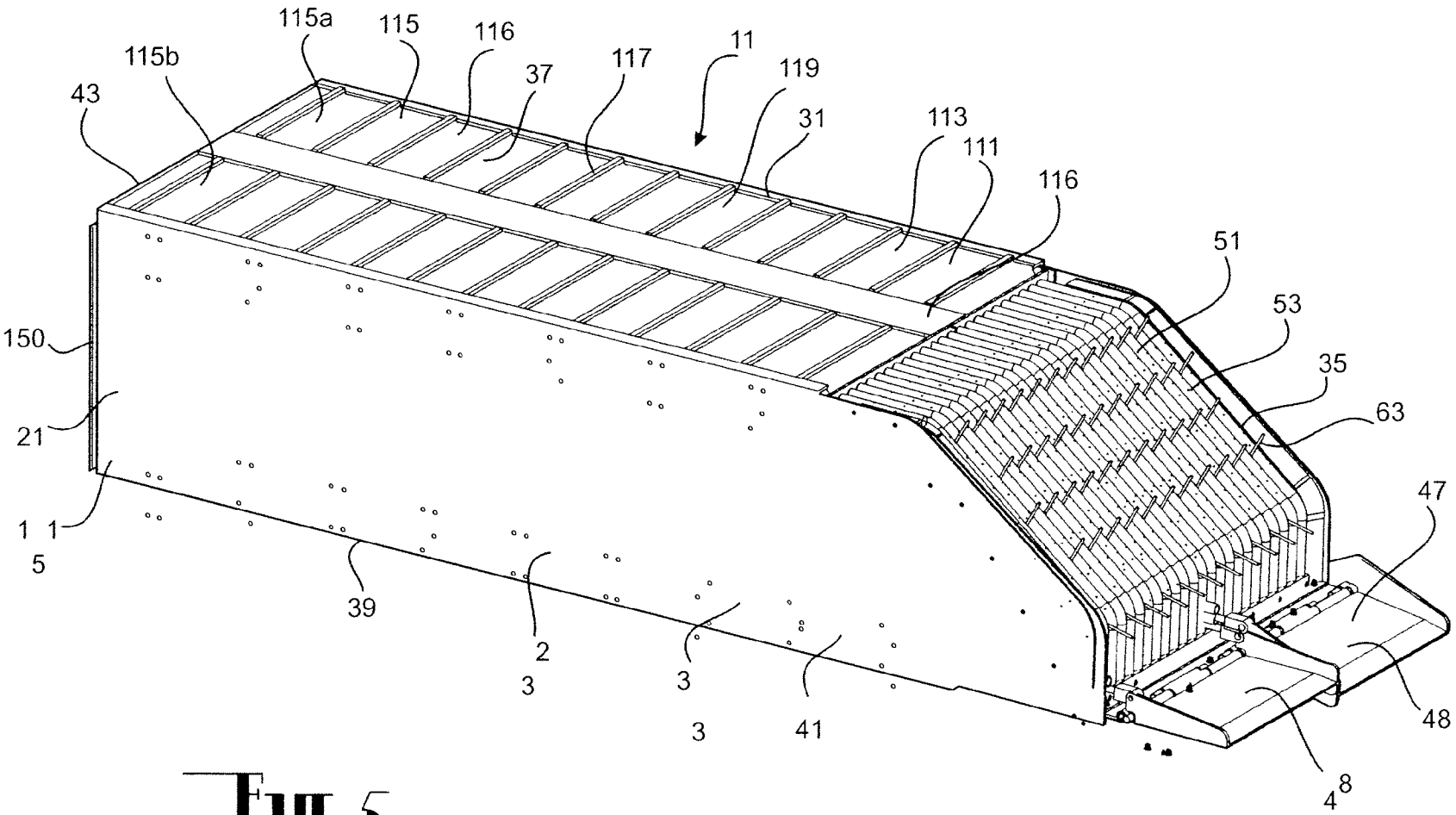
FIG. 5 is a perspective view of the mining head.
Figures 7, 8, 9:
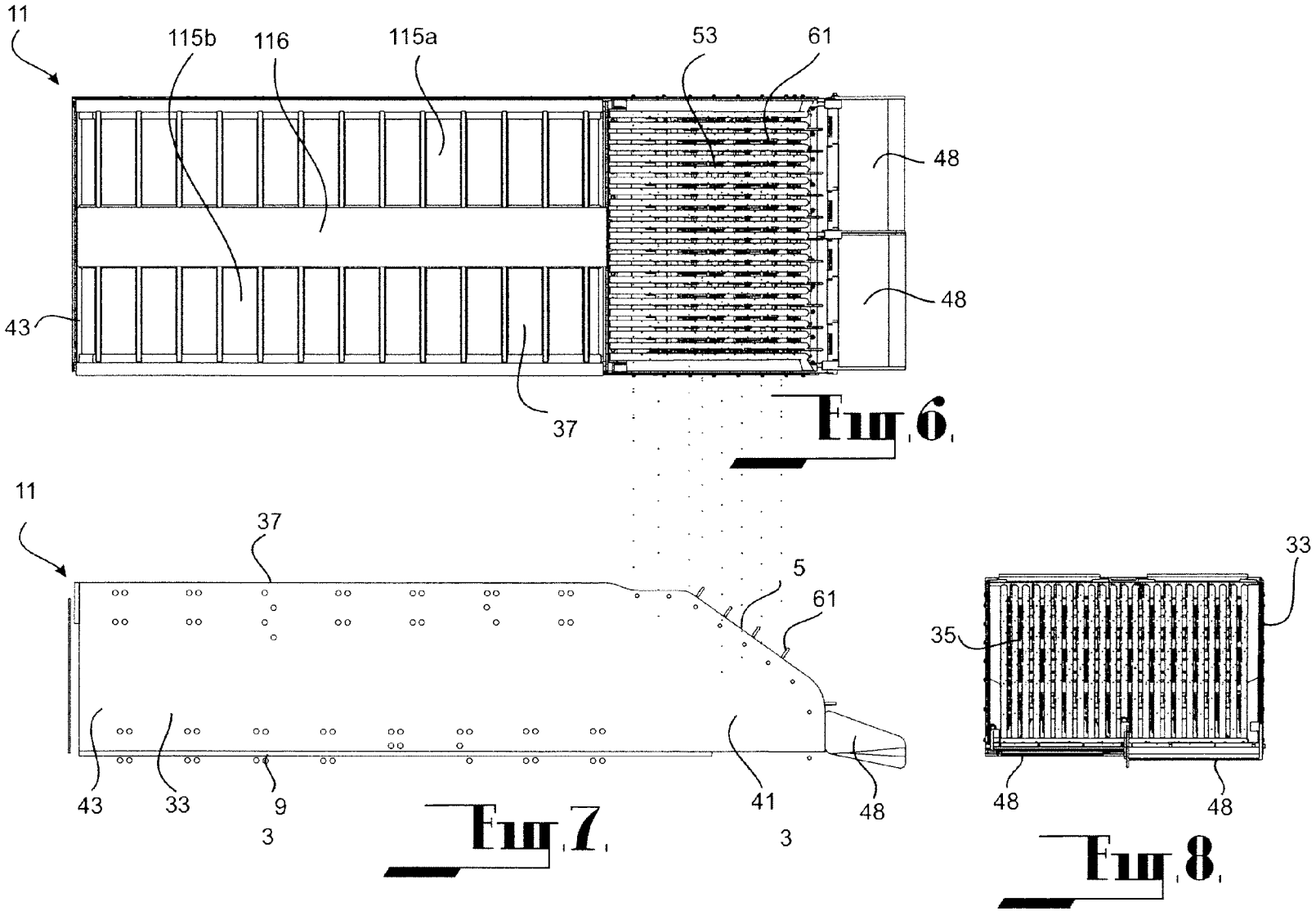
FIG. 7 is a side view of the mining head.
FIG. 8 is a front view of the mining head.
FIG. 9 is a perspective rendered view of the mining head, with some parts removed to reveal some internal workings.
Figure 9:
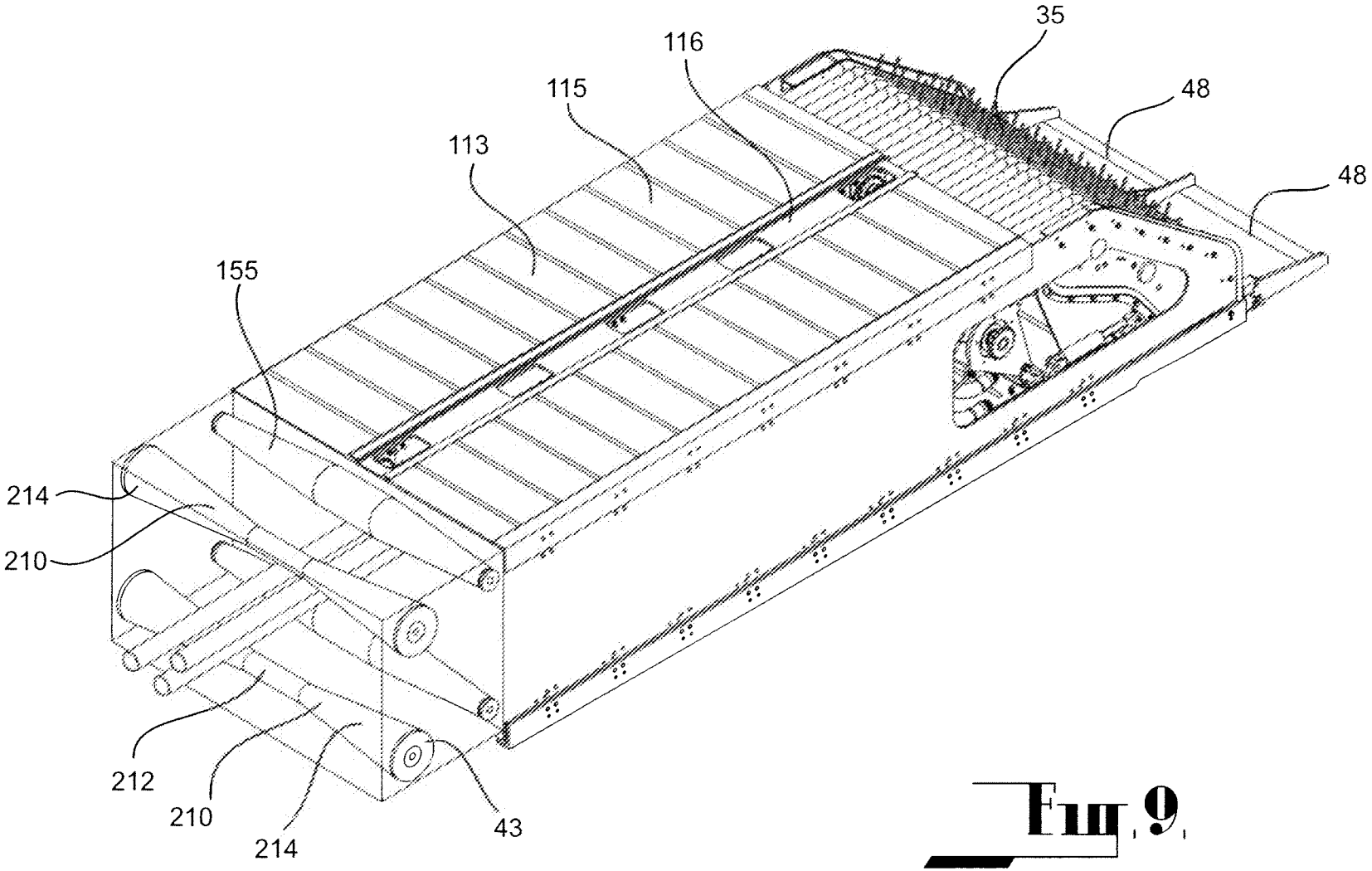
Figure 10:
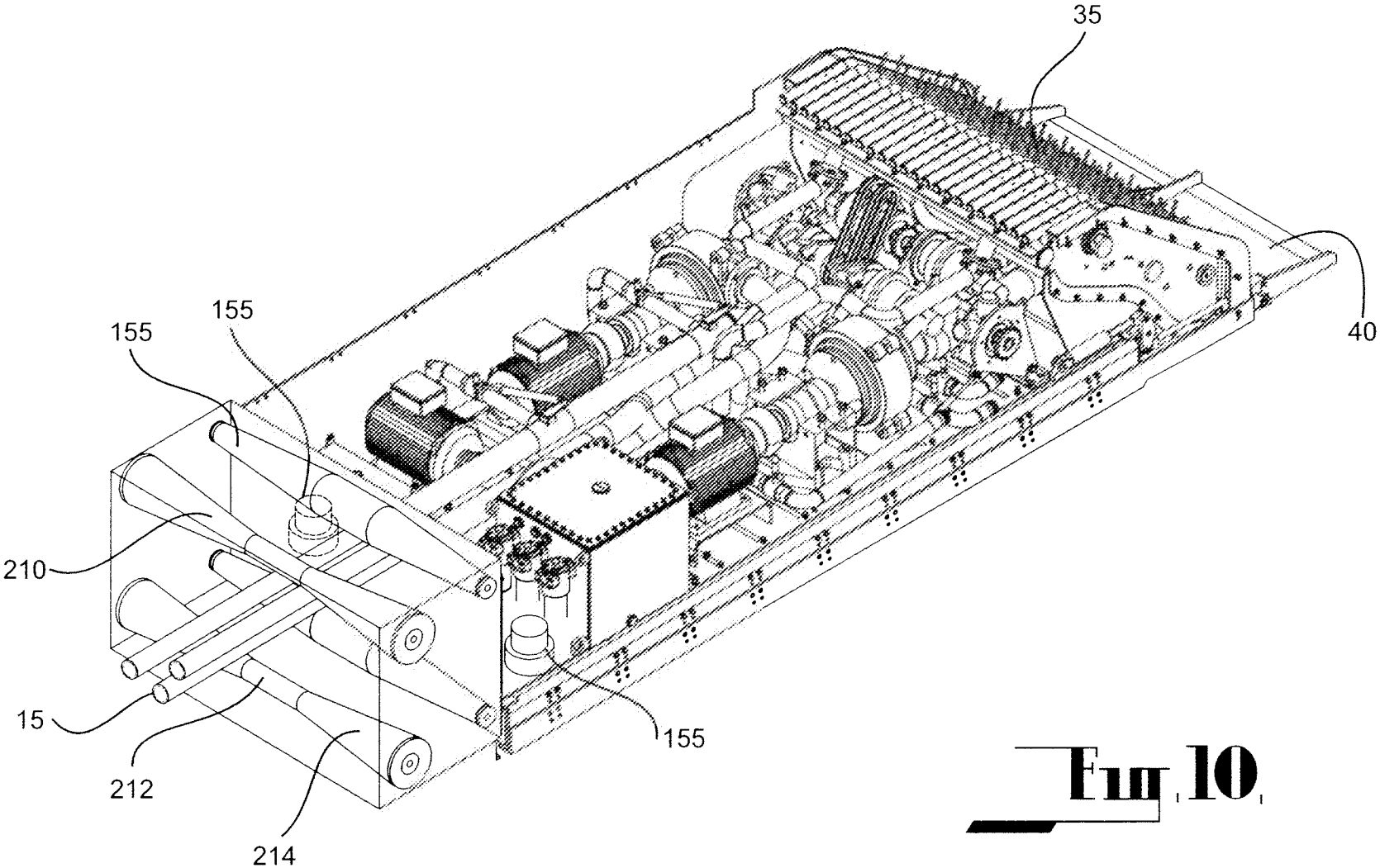
FIG. 10 is a rendered perspective view of the mining head, with other parts removed to reveal some internal workings.
Figure 11:
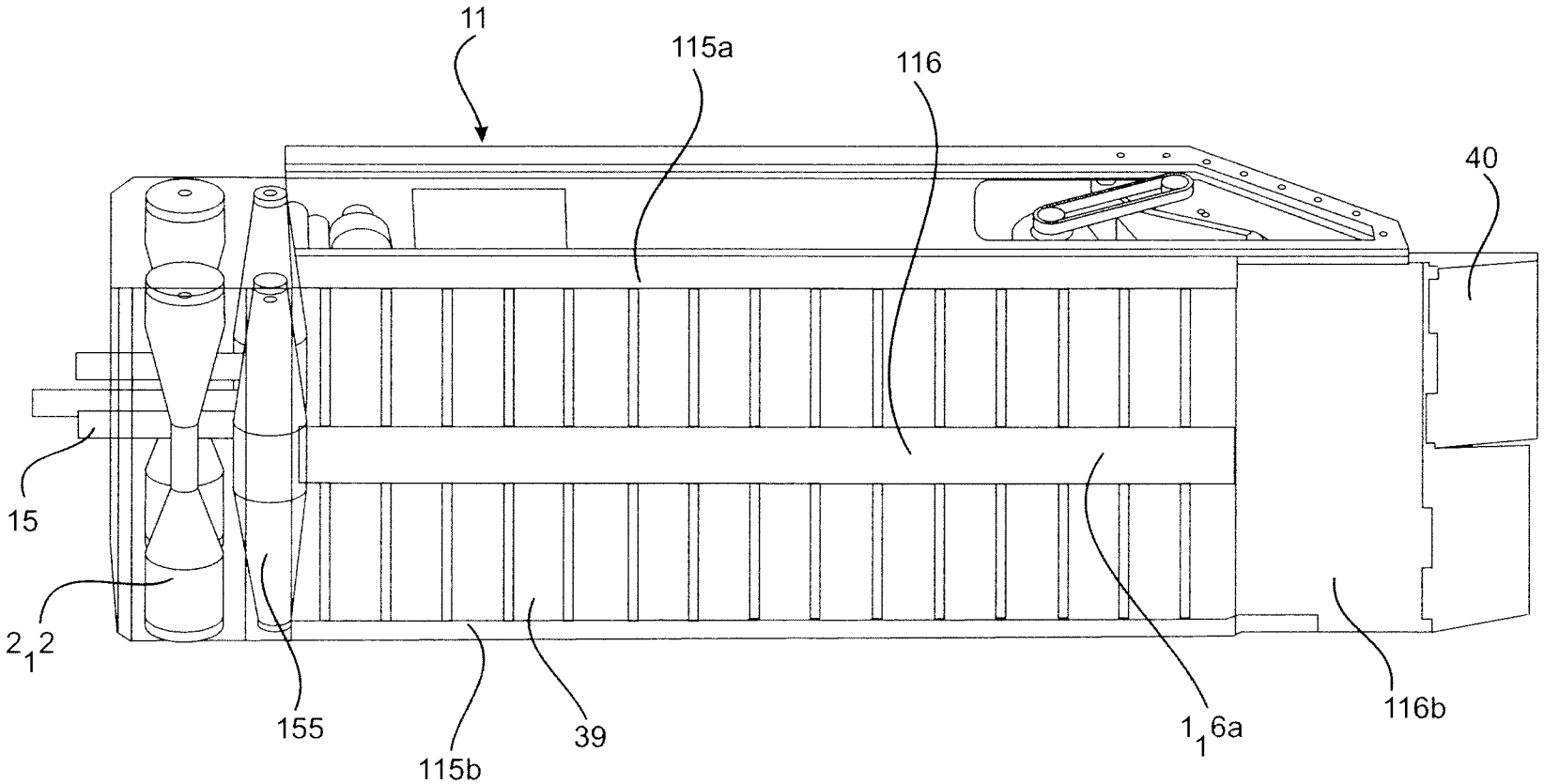
FIG. 11 is a view of the underside of the mining head.
Figure 12:
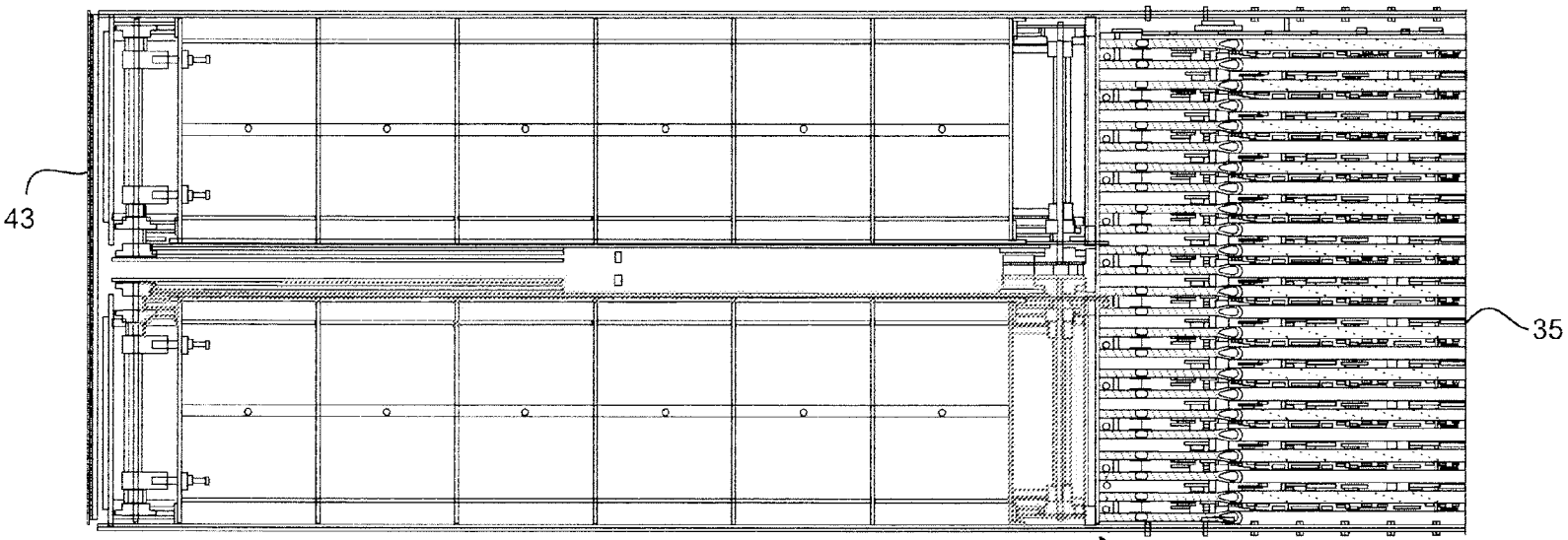
FIG. 12 is a plan view of the mining head with some parts removed to reveal some internal workings.
Figure 13:
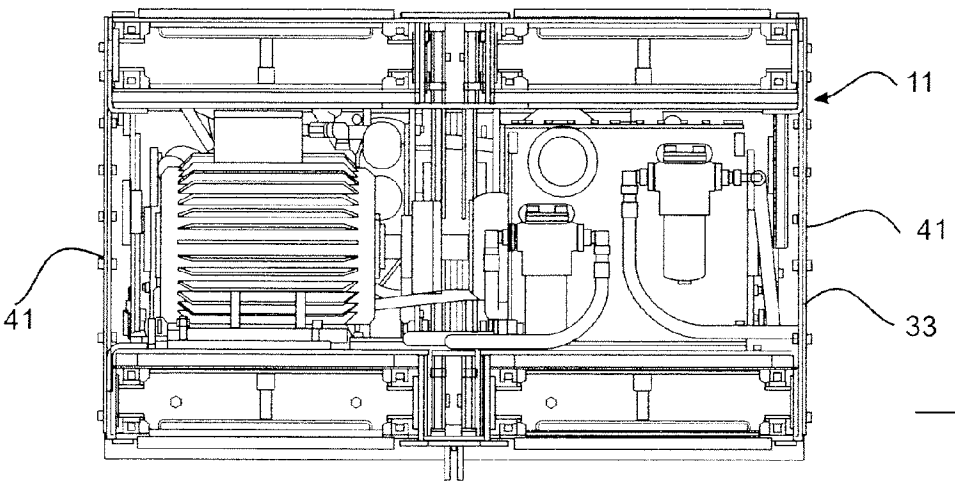
FIG. 13 is a sectional view of the mining head.
Figure 14:
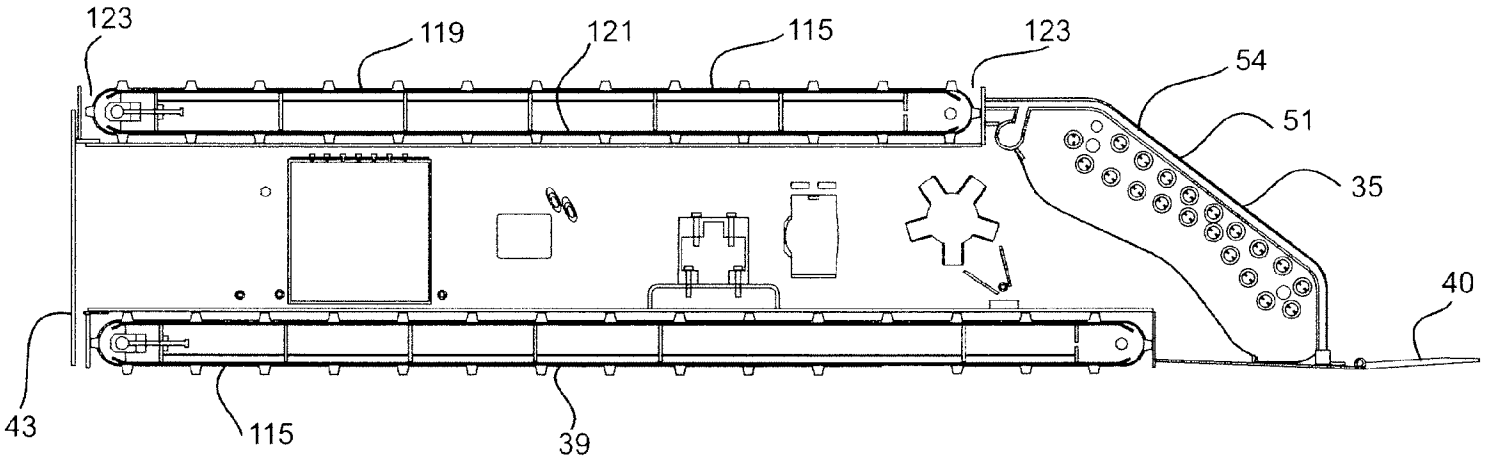
FIG. 14 is a schematic side view showing parts of the mining head.
Figure 15:
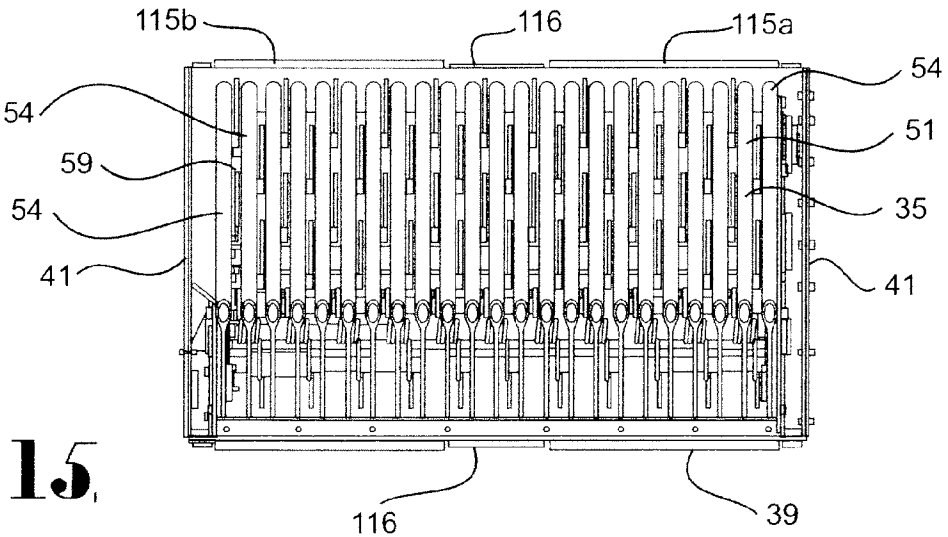
FIG. 15 is a front view of the mining head with a part cut-away to reveal some internal workings.
Figure 16:
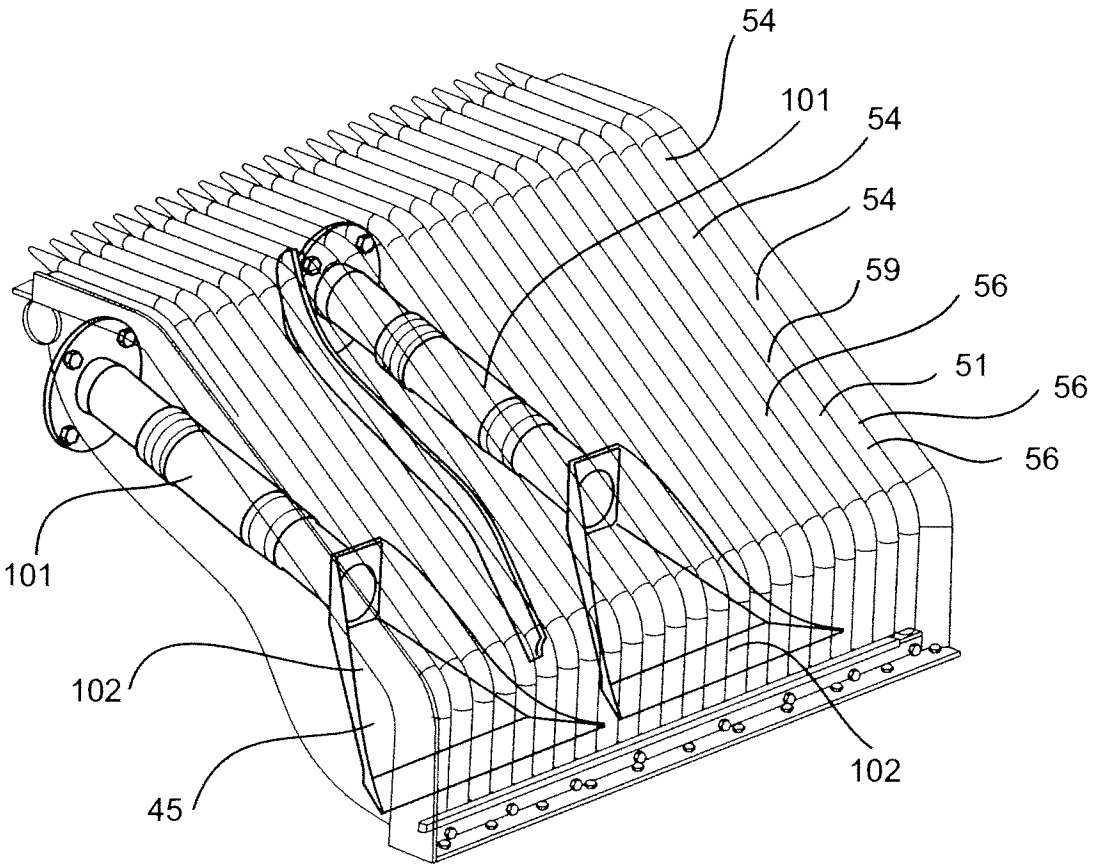
FIG. 16 is a schematic perspective view of a front part of the mining head illustrating in particular suction chambers accommodated in the mining head.
Figure 17:
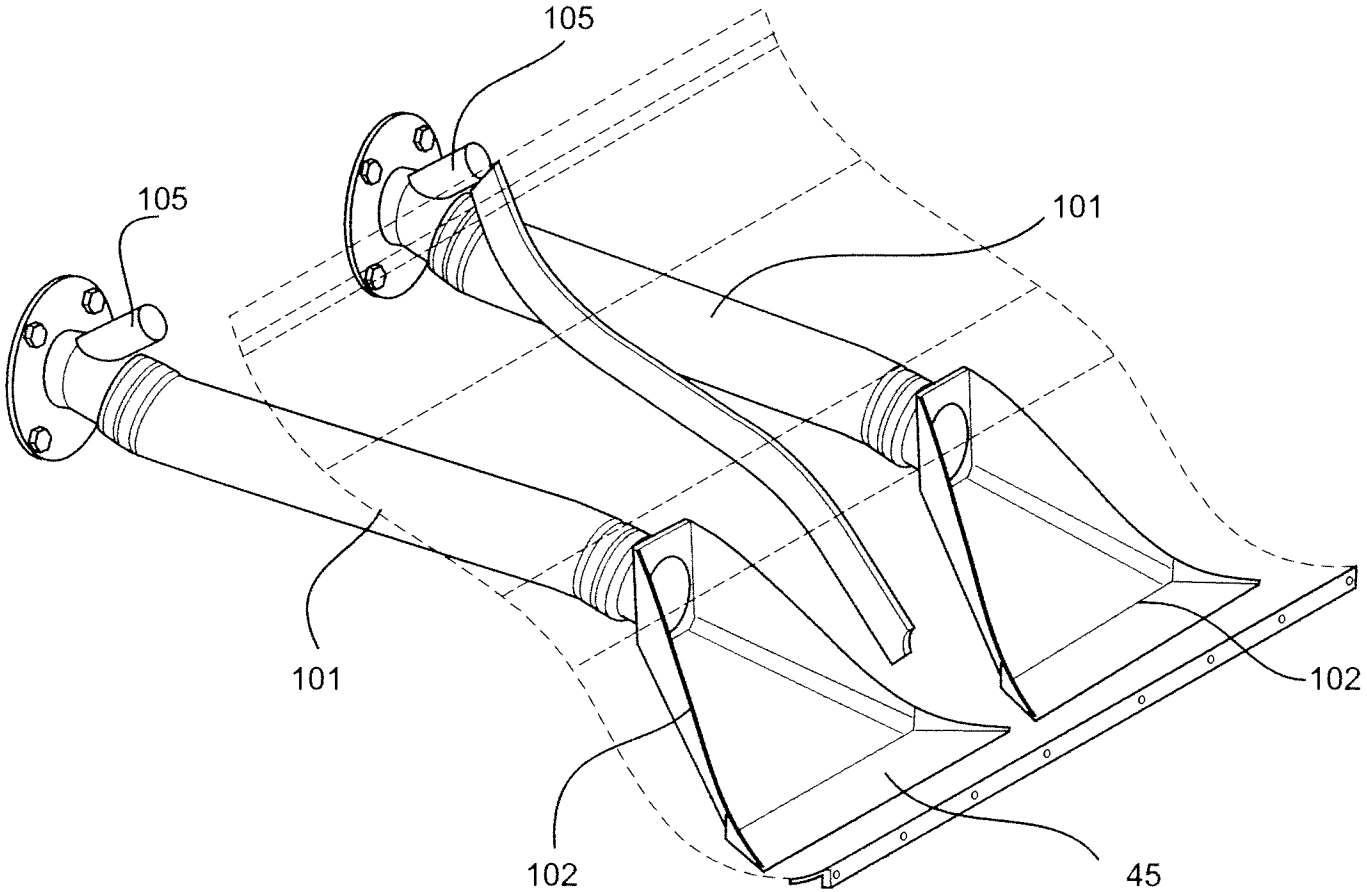
FIG. 17 is a schematic perspective view of the suction chambers.
Figure 18:
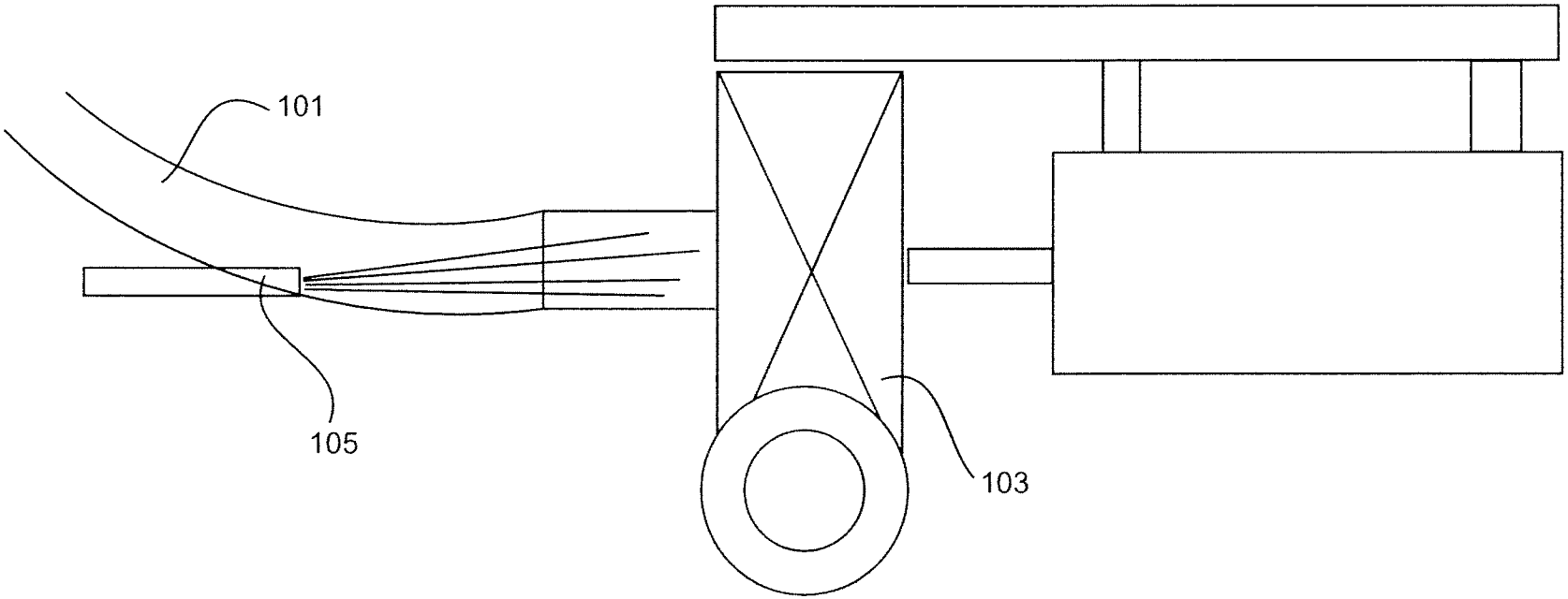
FIG. 18 is a view of a fluidising system used in association with the suction chambers.
Figure 19:
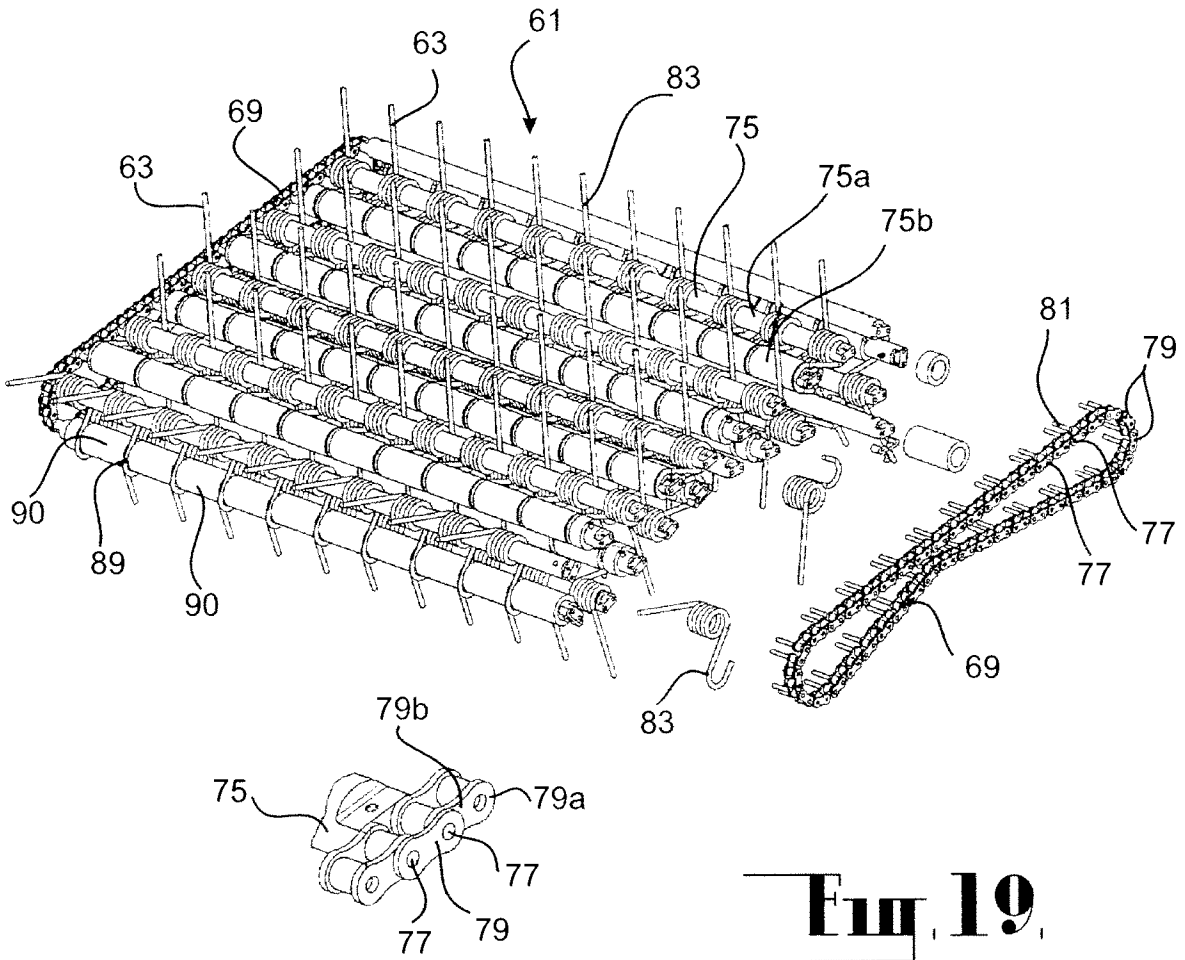
FIG. 19 is an exploded view of a tine assembly forming part of the mining head.
Figure 20:
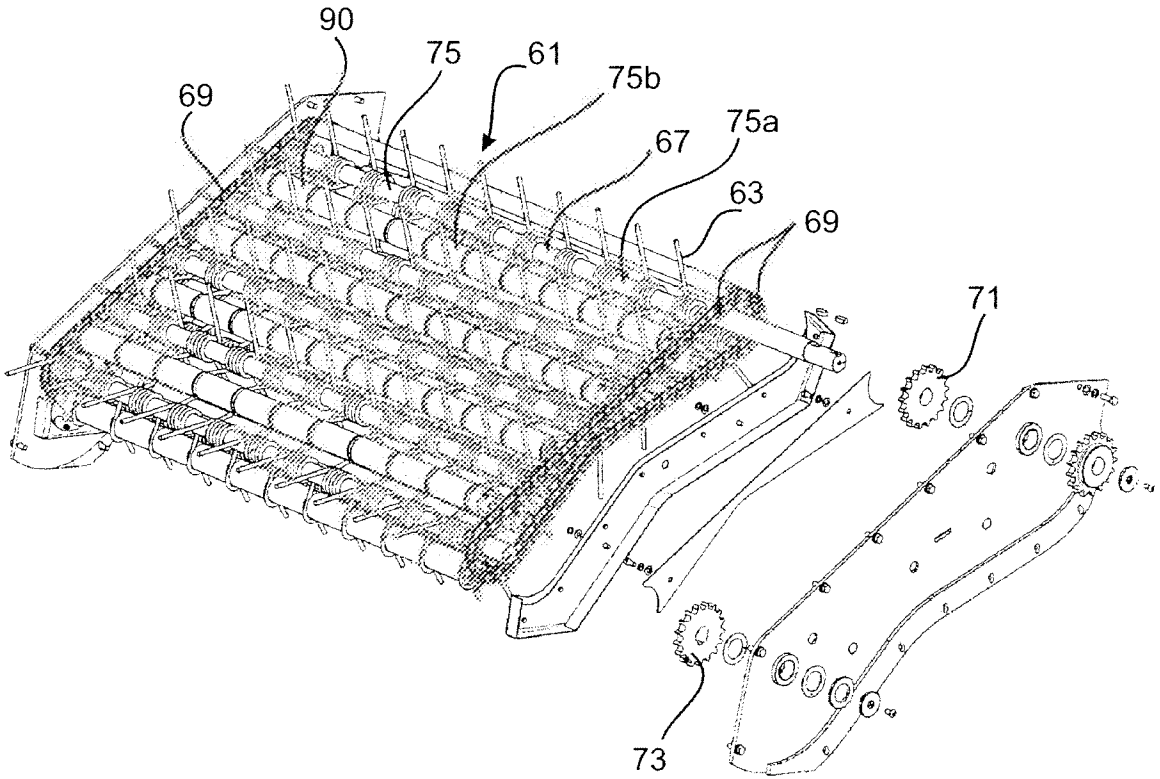
FIG. 20 is a further exploded view of the tine assembly and parts associated therewith.
Figure 21:
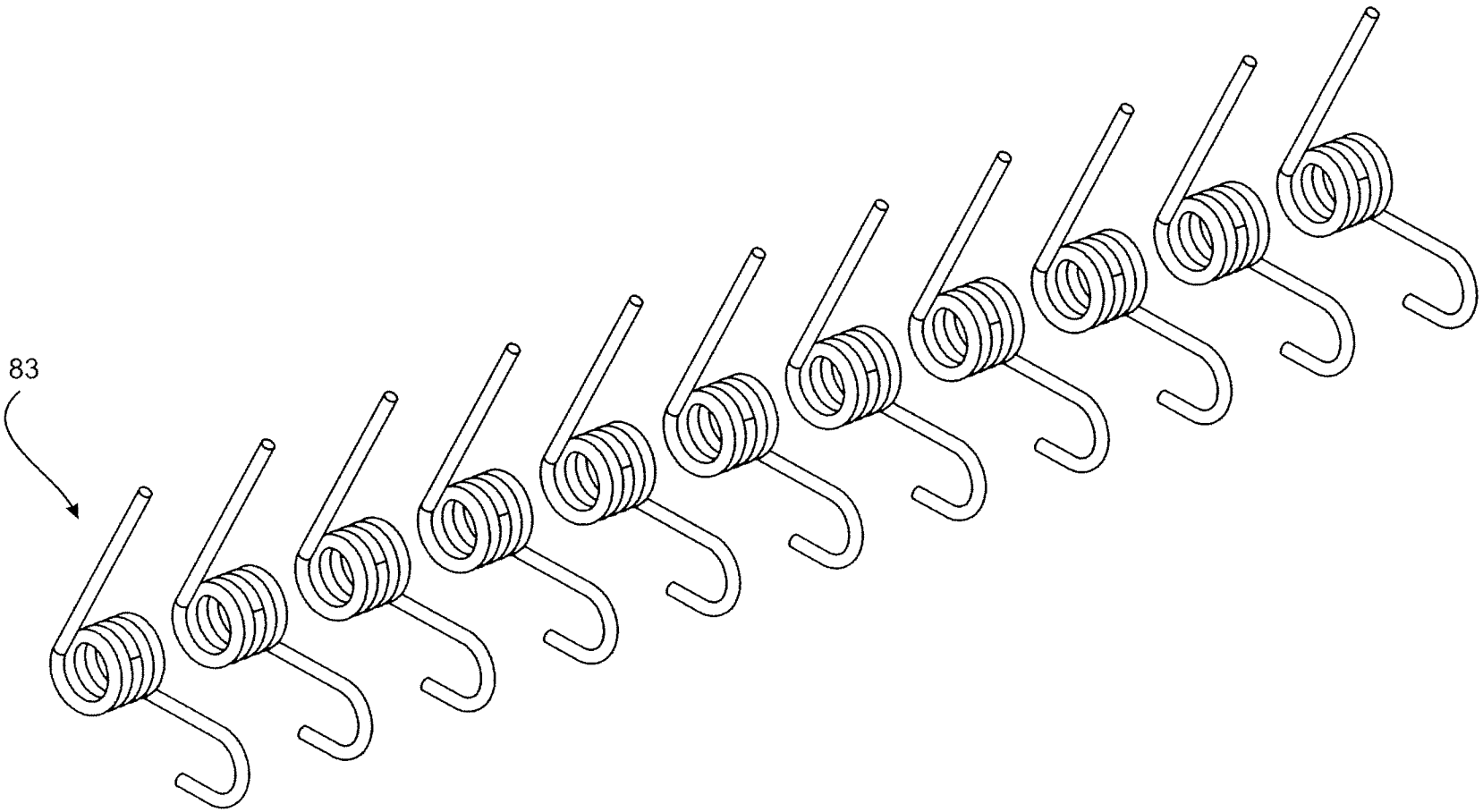
FIG. 21 is a perspective view of a series of tine structures forming part of the tine assembly.
Figure 24:
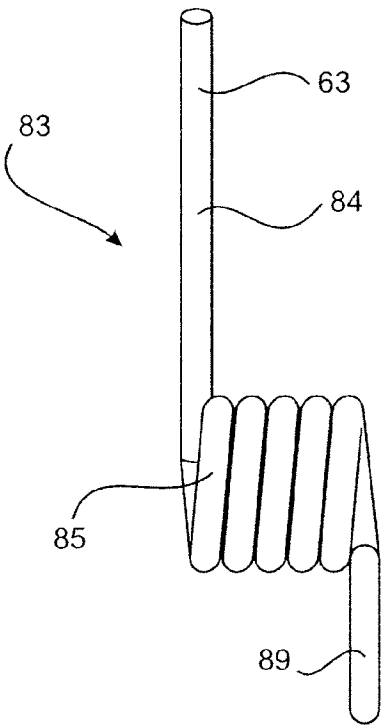
FIG. 24 is a front view of the tine structure.
Figure 23:
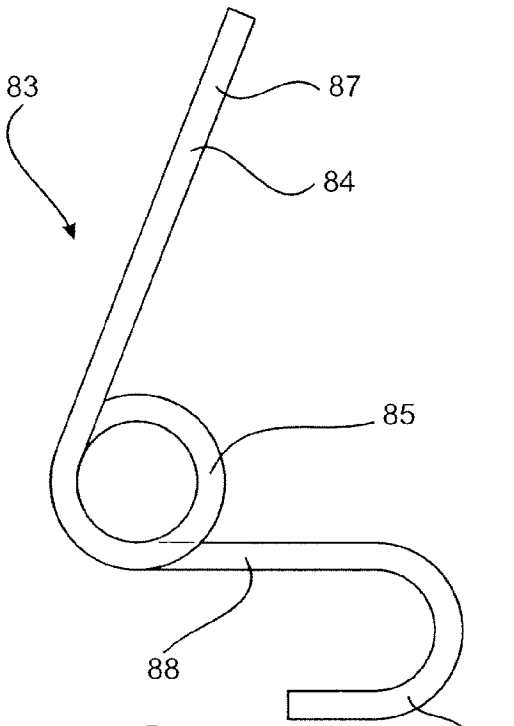
FIG. 23 is a side view of the tine structure.
Figure 22:
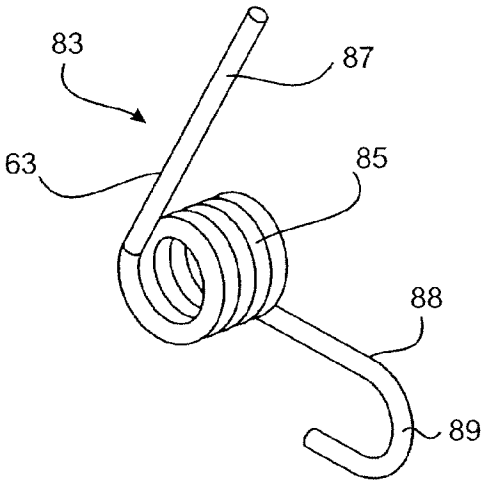
FIG. 22 is a perspective view of one tine structure.
Figure 25:
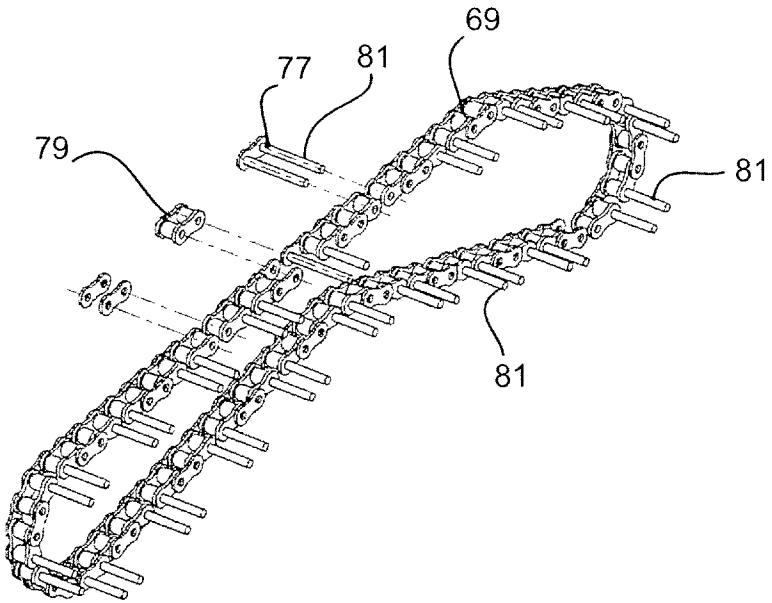
FIG. 25 is an exploded view of part of a support structure for the tines of the tine assembly.
Figure 26:
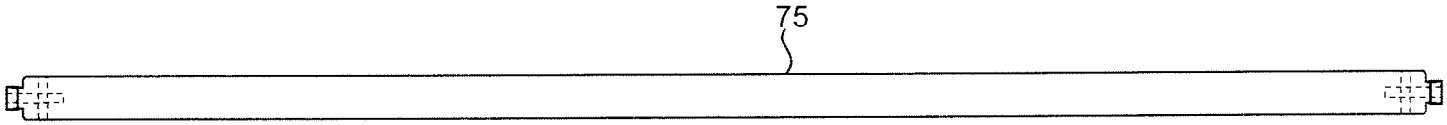
FIG. 26 is an elevational view of a support rod for the tine structures forming part of the tine assembly.
Figure 27:
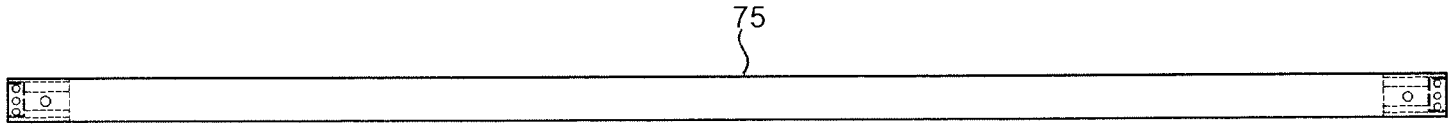
FIG. 27 is a plan view of the support rod.
Figure 28:
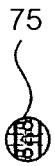
FIG. 28 is an end view of the support rod.
Figure 31:
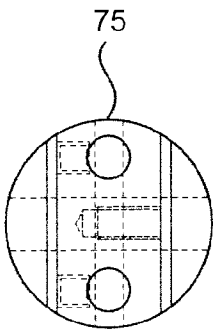
FIG. 31 is a detailed view of the end of the support rod shown in FIG. 28.
Figure 30:
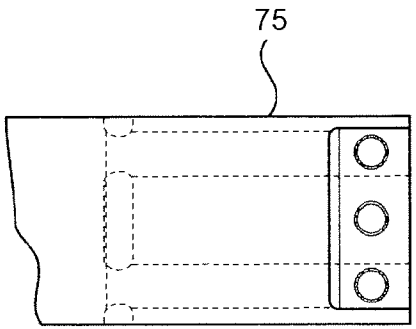
FIG. 30 is a detailed view at one end of the support rod shown in FIG. 27.
Figure 29:
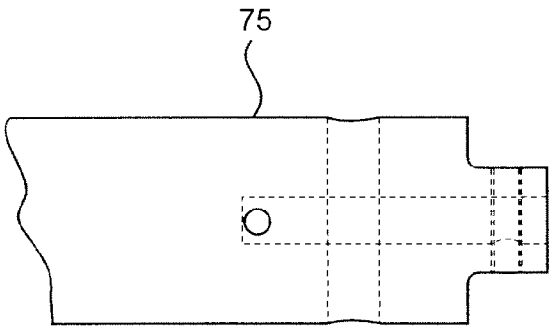
FIG. 29 is a detailed view at one end of the support rod shown in FIG. 26.
Figure 32:
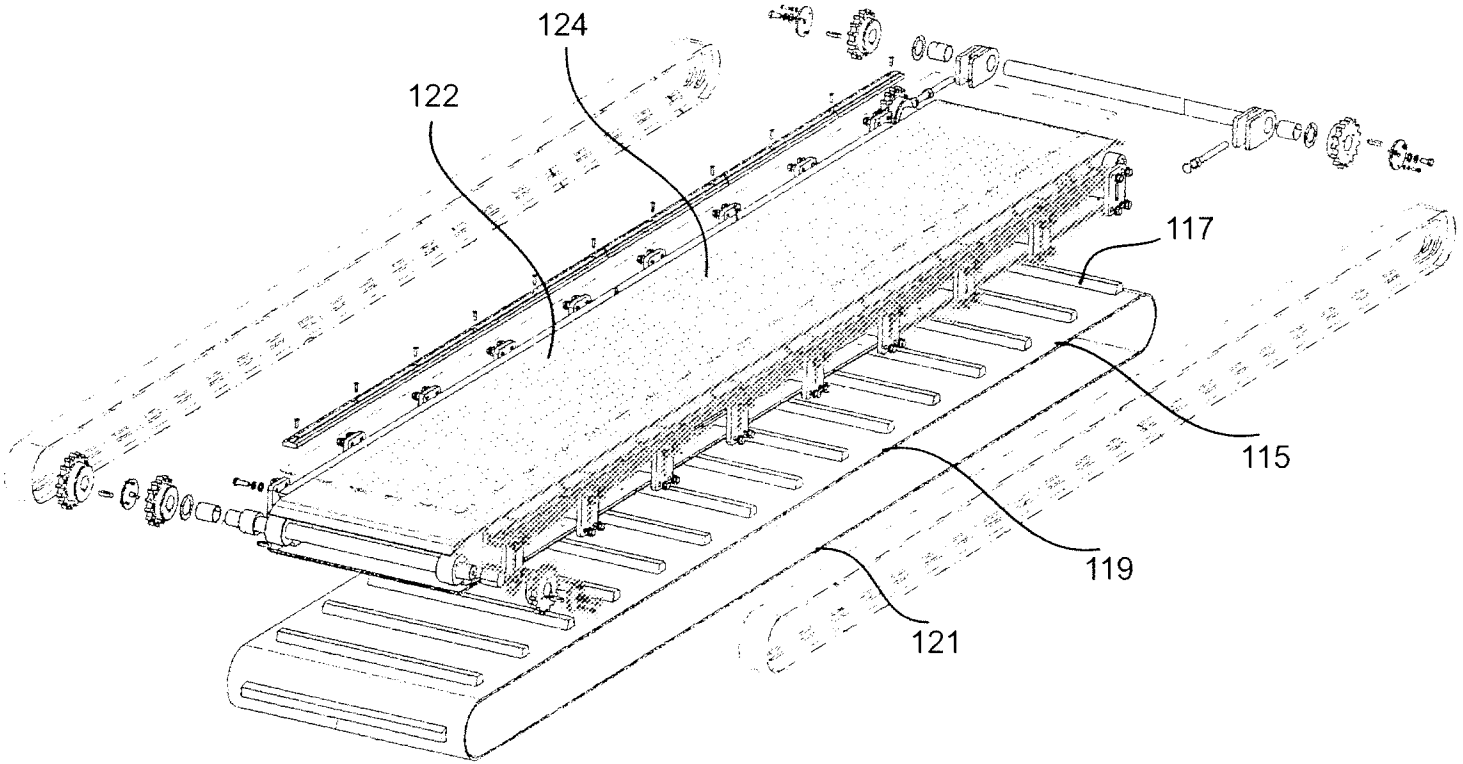
FIG. 32 is a fragmentary view of a drive track system for the apparatus.
Figure 33:
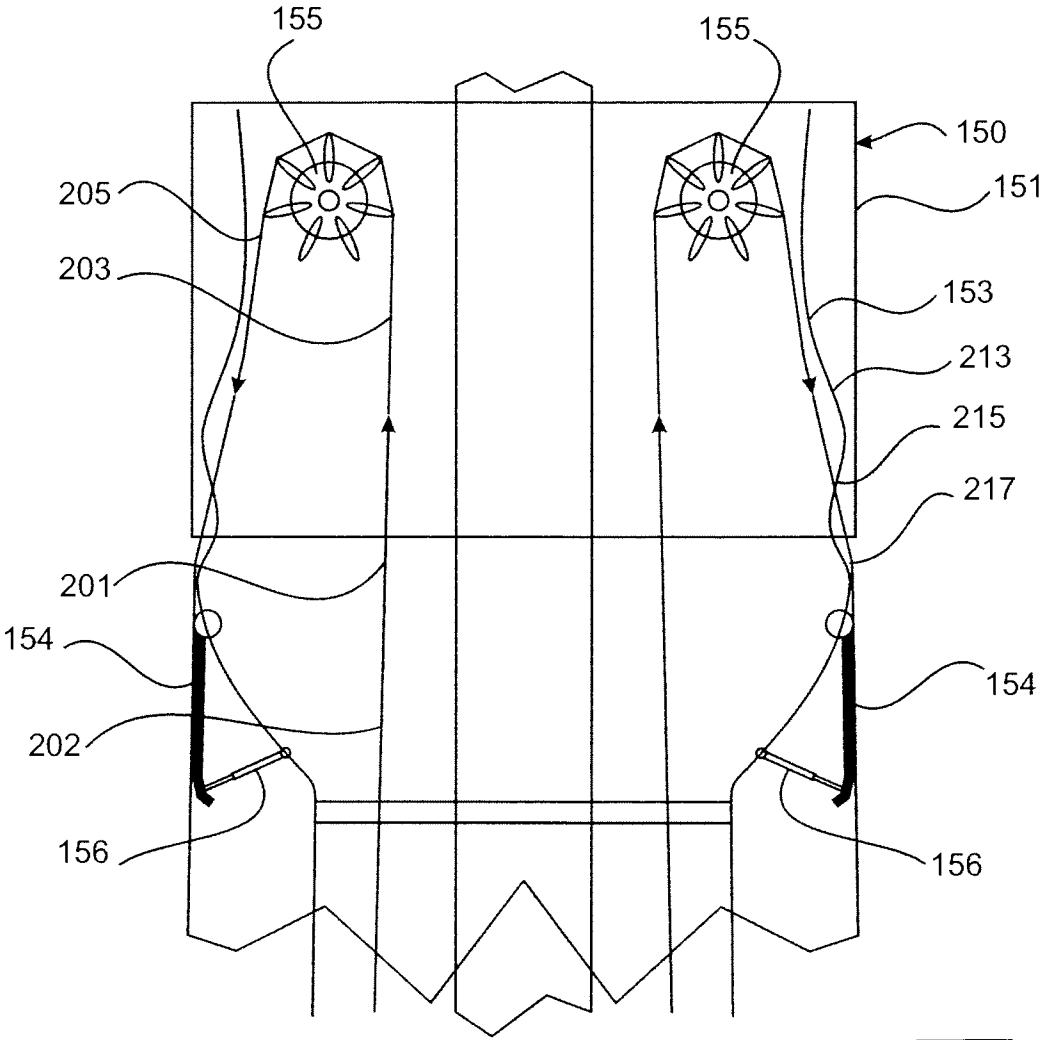
FIG. 33 is a schematic view illustrating part of the mining head showing in particular turn structures and a mandrill.
Figure 35:
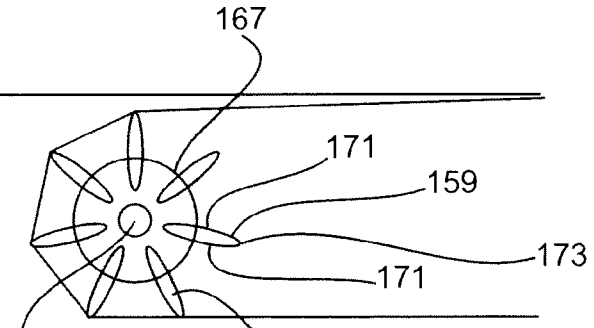
FIG. 35 is an end view of one of the turn structures.
Figure 34:
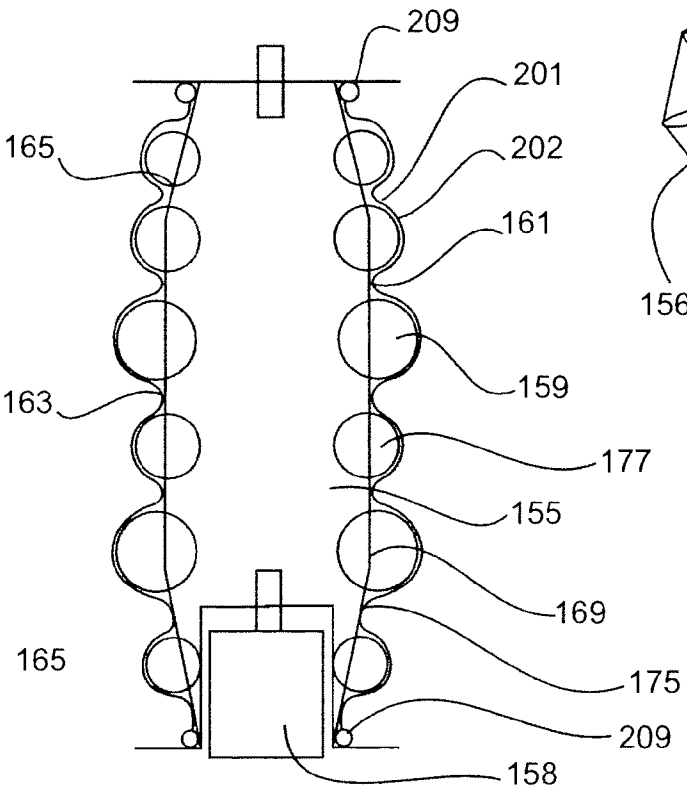
FIG. 34 is a plan view of one of the turn structures.

The embodiments shown in the drawings are each directed to apparatus for use in underground mining operations involving extraction of target material underground and delivery of the extracted material to a location (typically at ground level) for processing. The target material may be of any appropriate type, such as materials containing metallic particles such as gold, heavy metals, mineral sands and gemstones (including alluvial gold in deep leads, deep mineral sands and deep iron sands), oil sands and submerged tailings which can be extracted for retreatment.

The apparatus moves along an underground passageway which is formed and which is also supportingly lined against collapsing by the apparatus itself.

Referring to FIGS. 1 to 40, the apparatus 10 according to the first apparatus comprises a mining head 11 adapted to operate at the underground location to form the passageway 13 behind itself as it advances. An elongate structure 15 extends through the passageway 13 between the mining head 11 and a receiving and handling station 17 at ground surface level 19.

The mining head 11 and the elongate structure 15 therebehind are delivered in any appropriate way to the underground location from where the target material is to be recovered. A path may, for example, be excavated through the overburden to the underground location or the mining head may be utilised to progressively excavate material and thereby create a path for itself.

The apparatus 10 further includes means 21 for positioning a shroud 23 about at least a portion of the longitudinal periphery of the elongate structure 15 for supporting engagement with the periphery of the passageway 13 to provide a space through which the elongate structure can move, the shroud 23 having a cross-section corresponding generally in size and shape to the cross-section of the passageway formed by the mining head 11. In this embodiment, the passageway 13 formed by the mining head 11 is generally rectangular in cross-section, and the cross-sectional shape of the shroud 23 is also generally rectangular. The shroud 23 supports the surrounding material 14 so as to maintain the passageway 13. It is likely that some of the material 14 collapsed into position about the shroud 23 as the shroud was installed.

The mining head 11 comprises a body structure 31 incorporating a casing 32 having an exterior 33 which presents a generally rectangular profile to oncoming material as it advances through the underground location. The exterior 33 includes a front wall 35, top wall 37, bottom wall 39 and two side walls 41. The exterior 33 also includes a rear section 43 which forms part of the means 21 for positioning the shroud 23 about at least a portion of the longitudinal periphery of the elongate structure 15.

A suction chamber 45 is accommodated in the body structure 31 to receive slurry material extracted from the underground location. The suction chamber 45 incorporates two outlets 46 through which the slurry can be discharged.

The front wall 35 extends rearwardly and upwardly from a leading edge section 47 defined between the front and bottom walls 35, 39. Dive planes 48 are provided adjacent the leading edge section 47 for directional control of the mining head. There may be provision for vibration of the dive planes 48.

The front wall 35 also incorporates a screen 51 through which slurry material can pass to enter the suction chamber 45. The screen 51 comprises a grizzly 53 having a first side 55 which confronts the oncoming material and an opposed second side 57. The grizzly comprises a plurality of longitudinal elements 54 positioned in spaced apart side-by-side relationship to define gaps therebetween. The gaps provide elongate screen openings 59 through which slurry material can pass to enter the suction chamber 45.

The longitudinal elements 54 are of hollow construction to define conduits to carry water under pressure. The conduits incorporate a series of ports 56 defining nozzles through which water can issue under pressure as jets to assist in fragmenting material confronted by the mining head 11 and also assist in forming the slurry material.

A tine assembly 61 is associated with the screen 51. The tine assembly 61 serves to fragment oncoming material in the path of the mining head 11, as well as to remove any material accumulating in the screen openings 59 and also dislodge any over-size material such as rocks and boulders located against the screen 51.

The tine assembly 61 comprises a plurality of tines 63, each of which is movable through a respective cyclical path. A part of the cyclical path for each tine 63 includes a respective one of the screen openings 59, and another part has the tine 63 travelling within the suction chamber 45. In travelling within the suction chamber 45, the tines 63 serve to agitate the slurry within the chamber and thereby assist in maintaining solids in suspension.

Means may be provided for injecting water into the underground location ahead of the advancing apparatus to assist in generation of the slurry material. Such means may comprise water jets 58.

A zone 60 of slurry material may be formed ahead of the apparatus.

The zone 60 of slurry is generated immediately ahead of the apparatus by the action of the tines 63. The formation of the slurry may be assisted by vibration of the dive planes 48 and also vibration of other parts of the mining head 11. The zone 66 of slurry is in homeostasis, with no material entering or leaving the zone. With the movement of the tines 63 within the zone, typically at a speed in the order of 1.2 to 3.4 meters per second, the tines agitate the slurry within the zone 60 but nevertheless the state of homeostasis remains. The slurry will only move from that state when subjected to the suction effect of the apparatus. The zone of slurry presents little (if any)

resistance to the advancing mining head 11 as long as slurry material is drawn into the mining head as it advances. If the slurry material is not drawn from the slurry zone, it provides a barrier to advancing movement of the mining head. Slurry material which does not enter the apparatus can pass over the mining head as it advances. Once this by-passing slurry moves out of the influence of the agitating tines, it can settle around the mining head to be engaged by the drive system on the apparatus to provide traction, as will be described later.

The tines 63 are carried on a support structure 65 located adjacent the second side 57 of the screen 51, and are of a length to extend through the screen 51 and extend beyond the first side 55 thereof when travelling along the screen openings 59.

The support structure 65 comprises a closed loop structure 67 adapted for cyclical movement involving two main runs, one carrying the tines 63 in one direction along the screen openings 59 and the other carrying the tines in the other direction within the suction chamber 45. The closed loop structure 67 comprises two endless chains 69, one disposed adjacent each side wall 41 of the body structure 31. Each endless chain 69 passes around an upper sprocket 71 and a lower sprocket 73.

The support structure 65 further comprises a plurality of elongate support elements 75 configured as rods which extend transversely between the chains 69 and which carry the tines 63. The number of tines 63 carried on each rod 75 correspond to the number of screen openings 59 in the screen 51. Each support rod 75 is connected at its ends to the chains 69. More particularly, each end of the support rod 75 is connected to two pins 77, each pivotally connecting two links 79 in the respective chain 69. Each pin 77 has an extension portion 81 projecting laterally from the two links 79 which it connects, the extension portion 81 being connected to the respective end of the rod 75 to provide support therefor.

The tines 63 are moveably supported on alternate support rods 75 so as to be capable of deflection upon encountering an unmanageable obstruction. In this way, the tines can deflect rearwardly upon encountering an unmanageable obstruction that can be neither moved nor fragmented. The rearward angular deflection of the tines 63 allows them to sweep past the obstruction without damage to the tines.

Each tine 63 is defined by a tine structure 83 formed from a rod 84 of spring metal. The rod 84 is configured to have a coiled portion 85 defining a coil spring 86, a first extension portion 87 extending from one end of the coiled portion to define the tine 63 and a second extension portion 88 extending from the other end of the coiled portion 85. The coiled portion 85 is received on one rod 75*a* such that the tine 63 defined by the first extension portion 87 projects outwardly from the rod 75*a*, and the second extension portion 88 extends to an adjacent alternate rod 75*b* to act thereagainst when under load. The outer section of the second extension portion 88 incorporates a hook 89 for engaging the rod 75*b*.

The spring 86 serves to yieldingly resist the rearward deflection of the tine 63 and to return the tine to its upstanding condition after it has moved clear of the obstruction. With this arrangement, forces induced in the spring 86 upon angular deflection of the tine 63 are not transmitted as torsional forces to the support rod 75*a* carrying the tine (which would be the case if the spring were to be anchored to the particular support rod upon which the tine is carried) but rather as simply a reaction force applied to the adjacent support rod 75*b*.

Spacers 90 are provided on each alternate support rod 75*b* between adjacent hooks 89.

The tines 63 are configured to avoid clashing with each other, and with components of the support structure 65, as each endless chain 69 passes around the upper sprocket 71 and the lower sprocket 73.

Because the endless chains 69 are accommodated in the suction chamber 45, they are exposed to the slurry within the suction chamber. Solid particles in the slurry can provide grit material which is potentially aggressive to the endless chain 69 and likely to cause excessive wear. A flushing system (not shown) is therefore provided to flush the endless chains 69 to resist ingress of grit. The flushing system establishes a flushing fluid flow across each chain 69 in a direction inwardly towards the adjacent outlet 46 of the suction chamber 45, thereby serving to convey grit material in the slurry within the suction chamber in a direction away from the chain.

A peripheral seal (not shown) is provided around the outer periphery of each endless chain 69 to ensure that the flow of flushing fluid is across the chain. The seal (not shown) may comprise a brush seal arranged to sealing engage the outer elements 79*a* of the links 79 in the endless chain. Each link element 79*a* has a central waisted section 79*b*, and a gap is defined between the central waisted section 79*b* and the peripheral seal. The gap provides a flow path through which the flushing fluid can flow across the endless chain.

In an alternative arrangement (which is also not shown) the peripheral seal may be attached to the endless chain 69 for movement therewith, the seal being adapted to slidingly and sealingly engage a stationary surround around the periphery of the chain 69.

The flushing fluid comprises water sourced from the water supplied to the passageway as inflation fluid for the shroud 23, as will be explained in more detail later. The flushing water enters the suction chamber 45 and mixes with the slurry, and thus is drawn from the suction chamber through the outlet 46 as part of the slurry.

A positive fluid pressure is maintained at appropriate locations within the mining head to prevent ingress of sand and other foreign matter at unintended locations.

Indeed, the interior of the casing 32 communicates with the intention of the shroud 23 and so is under fluid pressure (being the water pressure from the water used to inflate the shroud to maintain it in supporting contact with the wall of the passageway 131, as will be explained later). With this arrangement, any leakage of water from within the casing 32 through gaps which might exist is beneficial in preventing ingress of sand and other foreign matter into the casing through such gaps.

The slurry outlets 46 each incorporate an outlet path 101 which extends to a pump system 103 accommodated in the body structure 31 for pumping the slurry upwardly to the receiving and handling station 17.

The slurry outlets 46 each include a slurry bin 102 at their inlet ends within the slurry chamber 45. The slurry bins 102 receive and direct the slurry to the outlet path 101.

An injection system 105 is provided for selectively injecting a flow of water under pressure into the outlet path 101 to enhance the fluidity of the slurry if necessary. The high pressure water flow can also assist conveyance of the slurry along the outlet path 101.

The pumping system 103 incorporates pumps which are electrically operated.

The support structure 65 is driven around its cyclical path by hydraulic drive motors which receive fluid power from electrically driven hydraulic pumps accommodated in the body structure 31. Electrical power for the various motors and other devices is supplied through electrical lines incorporated in the elongate structure 15.

A drive system 111 is provided for moving the mining head 111 through the underground location during excavation process and also moving it in the reverse direction as necessary along the passageway 13. The drive system 111 includes an endless track drives 113 associated with the top wall 37 and the bottom wall 39 of the body structure 31. The endless track drives 113 each comprise an endless track 115 having an outer side 116 incorporating integral drive cleats 117 for traction. Each endless track 115 has a driving run 119 for traction engagement with the upper periphery of the passageway 13 as it is created by the advancing mining head 11 and a return run 121. The driving run 119 is exposed to the exterior of the body structure 31, and the return run 121 is accommodated within the confines of the body structure 31. With this arrangement, the endless track 115 travels between the exterior and interior of the body structure 31, passing through access openings 123 in the casing 32.

The upper and lower endless tracks 115 are each provided as two side-by-side sections 115*a*, 115*b* separated by a skid 116.

The skid 116 at the bottom wall 39 comprises a central portion 116*a* and a skid plate 116*b* at the forward end of the central portion.

The driving run 119 is supported on a base 120 against which it slides. The base 120 comprises a surface 122 and a chamber containing water under pressure disposed adjacent to the surface 122. The surface 122 incorporates an array of pores 124 through which water from the chamber is emitted under pressure to generate a fluid support bed for the driving run 119.

A sealing system is associated with each access opening 123 to prevent the ingress of foreign matter into the interior of the body structure. The sealing system comprises a seal which slidably and sealingly contacts the outer side 116 of the endless track 115 and which is adapted for movement to accommodate variations in the outer side 116 because of the cleats 117. The seal is movable laterally with respect to the outer side 116 in order to maintain sealing contact therewith while also accommodating the cleats 117. For this purpose, the seal 127 is configured as a plate slidably supported on base for reciprocatory movement in the plane of the plate. The plate presents a sealing edge which engages the outer side 116, with the sealing edge moving with reciprocatory motion of the plate. The plate is adapted to reciprocate in timed sequence with the endless track 115 so that the sealing edge moves as necessary in order to maintain sealing contact with the outer side 116 of the endless track 115. Any appropriate mechanism may be used for reciprocating the plate, such as an electro-mechanical mechanism responsive to movement of the endless track 115 or a cam mechanism operably connected to the drive mechanism for the endless track.

For the purposes of friction reduction, the base supporting the plate has provision for generating a water film on which the plate is carried. Water is delivered at high pressure to establish the water film, and may be sourced from water supplied to the passageway 13 as inflation fluid for the shroud 23 or alternatively by way of a separate supply line.

The drive system for the mining head 11 may include other endless track drives of similar construction positioned at appropriate locations, such as in association with the side walls 41. In an alternative arrangement, the side walls 41 may incorporate endless tracks which may not be driven by a power source but merely move in response to reaction with the surrounding environment as the mining head moves. While this does not provide any propulsion, it does have the effect of reducing drag on the side walls The mining head 11 may, where appropriate, also have any one or more of the features of the mining head disclosed in International Application PCT/AU96/00106, the contents of which are incorporated herein by way of reference.

As referred to above, apparatus 10 further includes means 21 for positioning shroud 23 about at least a portion of the longitudinal periphery of the elongate structure 15 for supporting engagement with the periphery of the passageway 13 to provide a space through which the elongate structure can move, with the shroud 23 having a cross-sectional shape corresponding generally to the cross-sectional shape of the passageway 13 formed by the mining head 11.

Such means 21 comprises a deployment tool 150 provided at, and attached to, the rear section 43 of the mining head 11.

The deployment tool 150 comprises an exterior skin 151 having generally the same rectangular cross-sectional profile as the casing 33 of the body structure 31. The exterior skin 151 defines a housing accommodating a mandrel 153 and roller assemblies 155. The roller assemblies 155 are arranged in a rectangular configuration.

Each roller assembly 155 has a main axis of rotation 156 and comprises base 157 and a plurality of rotatable elements 159 mounted on the base. The base 157 may incorporate a drive motor 158 for rotating the base about axis 156.

The base 157 is of generally symmetrical configuration to present a cylindrical side surface 161. The cylindrical side surface 161 comprises a right cylindrical central portion 163 and two inwardly tapering end portions 165 of frusto-conical configuration. The base 157 also incorporates recesses 167 for accommodating the rotatable elements 159, with a portion of each rotatable element 159 projecting beyond the cylindrical side surface 161.

The rotatable elements 159 are each mounted on the base 157 for rotation about a respective axis of rotation 169 which is transverse to the main axis of rotation 156.

The rotatable elements 159 are each configured as a disc having two opposed broad surfaces 171 and a peripheral edge surface 173 extending therebetween. Each disc 159 is so mounted that its central axis defines its axis of rotation 169.

Each disc 158 is of lenticular configuration, whereby the broad surfaces 172 are of concave formation.

With this arrangement, each roller assembly 155 presents a tortuous profile, comprising the various intervening sections 175 of the cylindrical side surface 161 between adjacent discs 159, as well as the edge surface 173 and the exposed sections 177 of the opposed broad surfaces 171 of each disc.

The shroud 23 is assembled from a plurality of longitudinal shroud sections 201 adapted to be connected one to another at adjacent longitudinal edges. Each shroud section 201 is pliant and comprises a length of flexible cloth 202. There is one shroud section 201 corresponding to each side of the passageway 13 and therefore in this embodiment there and four shroud sections 201.

In assembly of the shroud, the shroud sections 201 are each turned around one of the roller assemblies 155 to provide an inner portion 203 which is moved along the passageway 13 with the elongate structure 15, and an outer portion 205 which is turned back with respect to the inner portion 203 and which is assembled into the shroud 23. The outer shroud sections 205 are connected one to another in a fluid-tight manner to form the shroud.

The shroud sections 201 are interconnected by complementary connector elements 207 provided at the longitudinal edges of the shroud sections. In this embodiment, the connector elements 207 provide a sliding seal or "zipper" connection between adjoining shroud sections.

Each shroud section 201 comprises two funicular elements 209 (such as cables or ropes) extending along the longitudinal marginal peripheries of the shroud cloth 202 to provide longitudinal tensile strength. The connector elements 207 are anchored to the funicular elements 209.

The inner portion 203 of each shroud section 201 assumes a laterally compacted condition in order that it may be accommodated in and moved along the space which is within the shroud 23 and in which the elongate structure 15 is also accommodated. Each inner portion 203 incorporates longitudinal folds 211 to provide the laterally compact condition.

It is necessary to move each shroud section 201 from the laterally compact condition occupied by the inner portion 203 into a laterally extended taut condition at the outer portion 205 so that the assembled shroud 23 can supportingly engage the periphery of the passageway 13. Movement of each shroud section 201 between the laterally compact condition and the laterally extended condition involves movement through an intermediate taut condition at the roller assembly 155 about which it turns.

As each shroud section 201 approaches its respective roller assembly 155 it first passes over a spreader roller 210 which causes the compacted shroud section to commence to open (spread laterally) prior to passing around the roller assembly 155.

Each spreader roller 210 has a troughed profile to receive the shroud section 201. The troughed profile comprises a base section 212 and two inclined side sections 214 which have provision (not shown) for engaging the funicular elements 209 at the longitudinal sides of the shroud section 201 to guide them outwardly, thereby laterally spreading cloth 202 to commence opening of the shroud section.

The tortuous profile presented by the roller assembly 155 causes that part of the shroud section 201 in contact therewith to assume the taut condition in which any wrinkles or creases are removed from the cloth 202 and from which it can spread to the fully extended condition as it moves away from the roller assembly 155 during assembly of the shroud. Because of the tortuous profile of the roller assembly 155, the spacing between two opposed ends of that part of the shroud section in contact with the roller assembly is considerably less than the width of the shroud material therebetween. It is because of this arrangement that that part of the shroud section 201 in contact with the roller assembly 155 is caused to assume the taut condition. The construction of each roller assembly 155 involving the rotatable base 157 and the rotatable discs 159 mounted thereon facilitates turning movement of the respective shroud section therearound.

As each outer portion 205 moves away from the respective roller assembly 155, it passes along the inner side 213 of the mandrel 153, through a slot 215 in the mandrel and then along the outer side 217 of the mandrel. This serves to assist opening of the outer portion 205 as well as stabilising the outer portion 205, which at this stage is exposed to the inflation pressure within the shroud 23, so that it retains its shape and taut condition while being connected to the other outer portions to form the assembled shroud. The roller assembly 155 may be continuously driven, even in circumstances where the mining head is not moving. The discs 158 effectively act as fingers which slide against the cloth 202 to exert force thereon to create tension in the cloth to prevent formation or wrinkles and creases.

The mandrel 153 includes pivotal mandrel sections 154 each of which can move pivotally under the action of ram 158 to urge the outer portion 205 into contact with the wall of the passageway 13. Sensors (not shown) may be associated with the pivotal mandrel sections 154 or the rams 158 to detect contact between the mandrel sections 154 and the wall of the passageway 13. This can be used as a measure to determine whether the deployment tool 150 is correctly aligned and located within the passageway 13 as the mining head 11 moves therealong.

The elongate structure 15 comprises a plurality of elongate elements 221 bundled together. The elongate elements 221 include cabling 223, conduits 225 and steel howsers 226. The cabling 223 may comprise electrical cabling, data communications cabling and other service lines, and the conduits 225 may comprise piping for the excavated slurry and also water. Cradles 222 are positioned at intervals along the elongate elements to retain them together. Each cradle 222 has a weighted base 224. The elongate elements 221 bundled together in a sock structure 227. The sock structure 227 includes an inner wall 229 which defines a sleeve 231 within which the bundle of elongate elements 221 are encapsulated, and an outer wall 233 spaced from the inner wall 231 to define a chamber 235 within which the shroud sections 201 are accommodated as they move along the passageway 13.

The chamber 235 is divided into a plurality of sub-chambers 237, one corresponding to each shroud section 201, by partition walls 239 extending between the inner and outer walls 229, 233.

As previously mentioned an inflation fluid is provided for inflating the shroud 23 and maintaining it in supporting engagement with the periphery of the passageway 13.

A further inflation fluid is also introduced into the various sub-chambers 237 for inflating the sub chambers. The inflation pressure within the sub chambers 237 is marginally higher than the inflation pressure within the shroud 23 to which the exterior of the sock structure 227 is exposed. This ensures that the sub-chamber 237 remains in an inflated condition.

The inflation pressure in the sub-chambers 237 acts upon the sleeve 231 defined by the inner wall 229 to urge the sleeve into a tightly wrapped condition about the bundle of elongate elements 221.

In this embodiment, the inflation fluid in each case comprises water. In this way, the shroud sections 201 have some buoyancy and can be "floated" along the sub-chambers 237.

The sleeve 231, which tightly envelopes the bundle of elongate elements 221, isolates the shroud sections 201 from the elongate elements 221, thereby avoiding entanglement.

The sock structure 227 is progressively fitted onto the elongate structure 15 (i.e. the bundle of elongate elements 221) as the latter is progressively introduced into the passageway 13 at station 17. In fitting the sock structure 227 onto the elongate structure 15, the inner wall 229 is progressively wrapped around the elongate structure 15 and then closed upon itself so as to progressively encapsulate the elongate structure. The inner wall 229 is closed upon itself in a fluid-tight manner by a zipper arrangement 241. Similarly, the outer wall 233 is progressively closed about the shroud sections 201 as they are progressively introduced into the passageway. The outer wall 233 is closed in a fluid-tight manner by zipper arrangements 243 associated with the various sub-chambers 237.

The sock structure 227 can be stored in roll form, and unwound from the roll and progressively delivered to the elongate structure 15 at station 17.

Conduits 225 in the form of pipes forming part of the bundle of elongate elements 221 can conveniently comprise a plurality of pipe sections which are connected one to another at station 17. Other elongate elements in the bundle (such as cabling 223) can conveniently be stored in roll form, and unwound from the roll and progressively delivered to the elongate structure 15 at station 17. Similarly, the shroud sections 201 can be conveniently stored in roll form, and unwound from the roll and progressively delivered to the elongate structure at station 17.

The inflation fluid (water) is progressively introduced into the shroud 23 assembled from the interconnected outer portions 205 to cause inflation thereof as it progressively advances along the passageway 13. Additionally, inflation fluid (water) is introduced into the sub-chambers 237 as they progressively advance along the passageway 13 with the elongate structure.

From the foregoing, it is evident that the present embodiment can provide apparatus for movement along an underground passageway which is formed and also supportingly lined against collapsing by the apparatus itself, with the cross-sectional profile of the lining corresponding generally with that of the passageway as created. The apparatus can operate in wet, continuously collapsing geological environments such as alluvial and marine deposits. In areas where the target material is covered with a surface cover or overburden such as sand or gravel, the apparatus can tunnel its way through the surface cover or overburden to access the target material below.

It is a feature of the apparatus that all power supplies (electrical power and fluid power) are delivered from ground surface level via umbilicals such as the cabling 223 and conduits 225. With this arrangement, the mining head 11 need not carry fuel or power supplies for the various motors onboard.

In the first embodiment described, each roller assembly 155 has a main axis of rotation 156 and comprises base 157 and a plurality of rotatable elements 159 mounted on the base.

Figure 43:
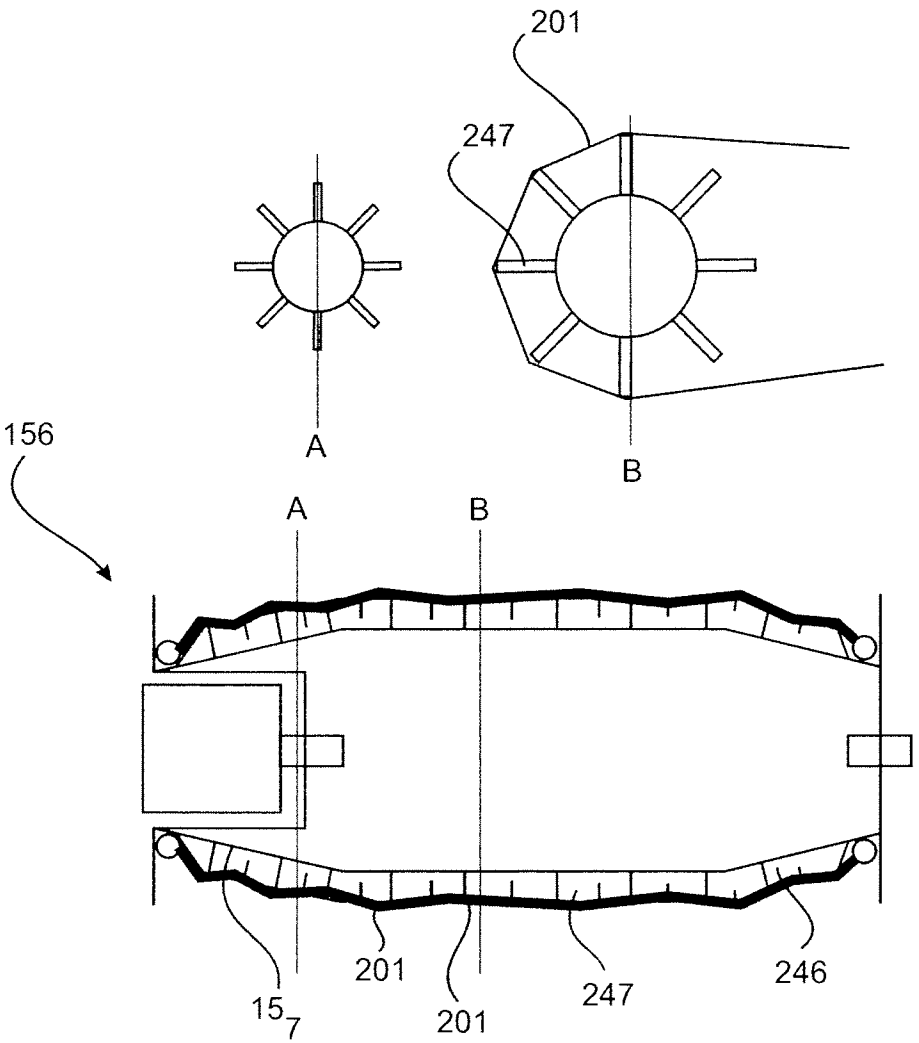
FIG. 43 is a view similar to FIG. 41, with the exception that cloth is shown passing around the turn structure and the turn structure deforming to present a tortuous profile for engagement by the cloth.
Figure 44:
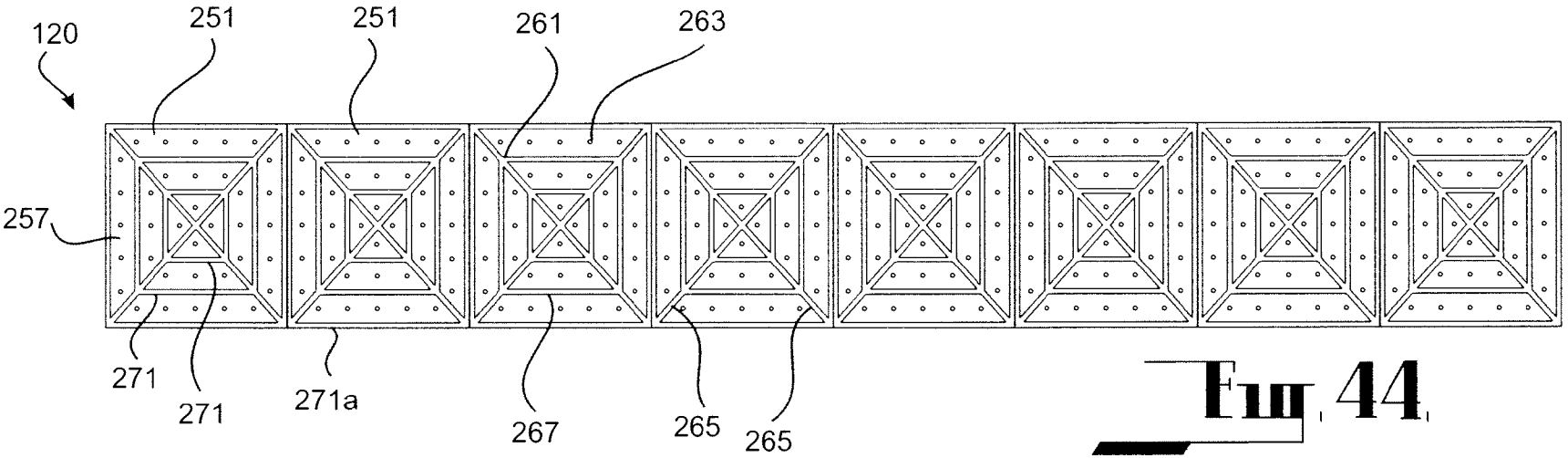
FIG. 44 is a schematic view of part of a base for apparatus according to a fourth embodiment.

The second embodiment of the invention, which is shown in FIGS. 41 to 43, is similar to the first embodiment, apart from the rotatable element 159 on the base 157 being replaced by elements 300 projecting from the base. The elements 300 cooperate with the surface of the base 157 to present a tortuous profile about which the shroud section can turn as previously described.

In this embodiment, the elements 246 comprise vanes 247 of plastics material which can flex or otherwise deform to present a tortuous profile when contacted by the shroud section.

Preferably, the vanes 247 are of a plastics material presenting a low-friction surface upon which the shroud section can easily slide.

In a third embodiment (not shown), each roller assembly 155 comprises a roller structure presenting a roller contact surface having zones with different support characteristics such that the contact surface presents a tortuous profile when contacted by the shroud section. By way of example, the roller structure may comprise a plurality of bristles which cooperate to define the roller contact surface, with some bristles having different resiliency characteristics to other bristles and thereby deflecting to different extents when contacted by the shroud section as it passes around the roller structure.

In the first embodiment, the driving run 119 of each endless track 115 was slidingly supported on a base 120 which formed a fluid support bed. The base 120 comprised a surface 122 incorporating an array of pores 124 and a chamber containing water under pressure disposed below the surface.

Figure 45:
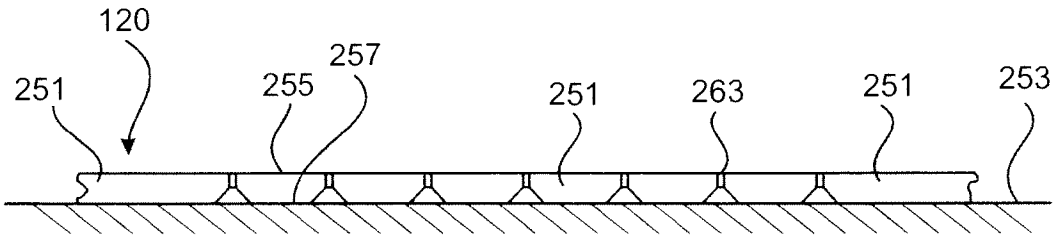
FIG. 45 is a sectional view of part of the base as shown in FIG. 44.
Figure 46:
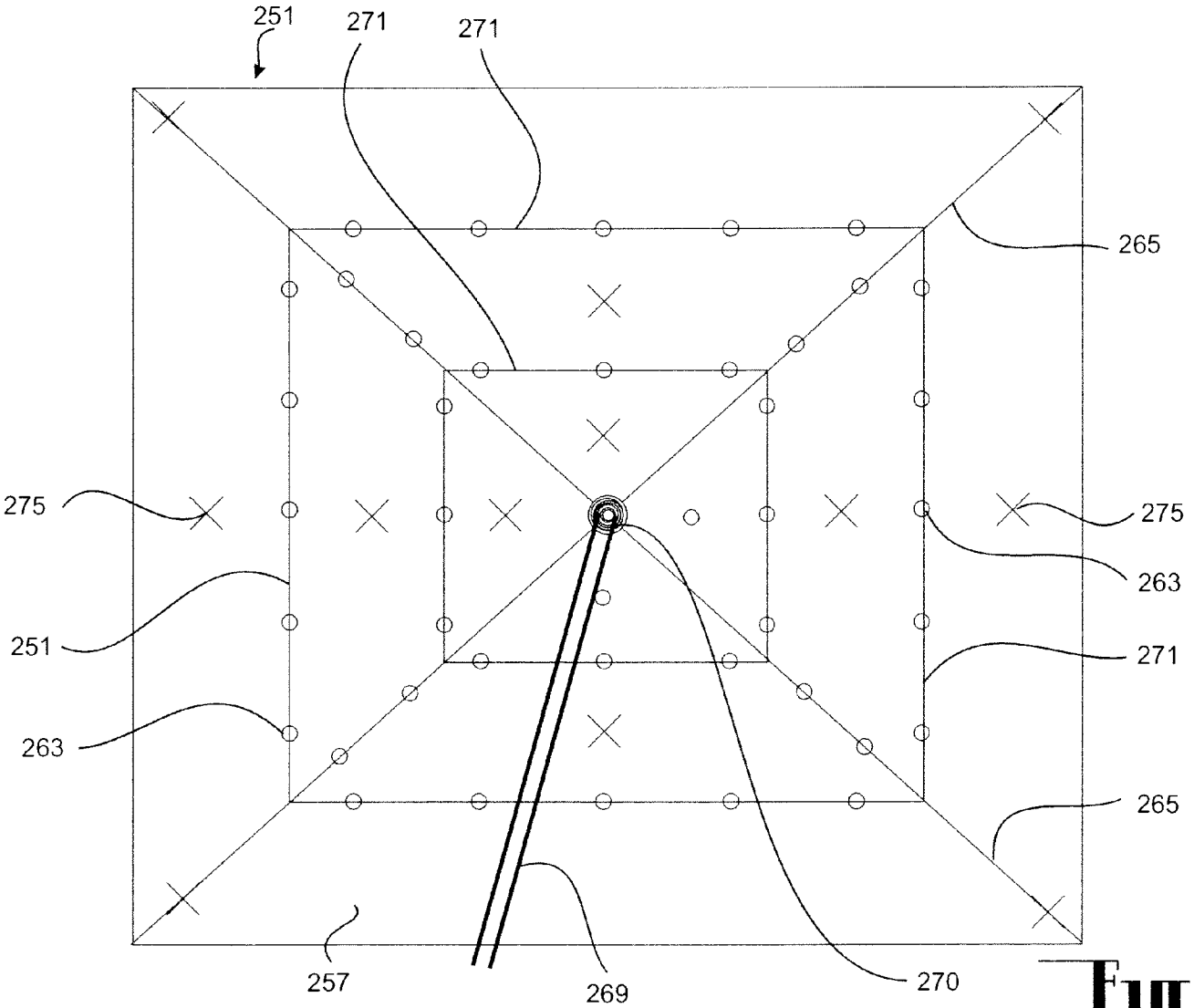
FIG. 46 is a schematic view of the under side of a sheet used to form part of the base of FIG. 44.

Referring now to FIGS. 45 and 46, there is shown a base 120 for apparatus according to a fourth embodiment. The apparatus according to this fourth embodiment is similar to the apparatus according to the first embodiment, apart from the construction of the base 120. In the fourth embodiment, the base 120 comprises a plurality of sheets 251 located in an array on a support surface 253. Each sheet 251 has an upper surface 255 and a lower surface 257 which locates on the support surface 253. Each sheet 251 has a channel formation 261 which opens onto the lower surface 257. The channel formation 261 cooperates with the support surface 253 to form ducts 262 which communicate with a source of fluid (such as water) under pressure. Pores 263 extend between the channel formation 251 and the upper surface 255 to emit fluid under pressure to establish a fluid support bed at the upper surface. In the arrangement shown, each sheet 251 is rectangular, and the channel formation 261 thereon comprises two intersecting diagonal channels 265 extending between opposed corners of the rectangular sheet and transverse channels 267 extending between the diagonal channels. The transverse channels 267 are arranged to establish one or more rectangular formations 271, each with one transverse channel parallel to one side of the rectangular sheet. In the arrangement shown, there are three rectangular formations 271 on each sheet 251, including one at the periphery of the sheet. The diagonal channels 265 and the transverse channels 267 cooperate to provide a reticulation network 268 for delivery of water through the pore in the sheets 251 to create the fluid bed for supporting the endless track 115.

In this embodiment, each sheet 251 is formed from ultra-high molecular weight polyethylene (UHMWPE) or teflon. The sheet is attached to the support surface 253 in any appropriate way, such as mechanically by fasteners 295.

With this arrangement, there is only need for a water supply line to the reticulation network 268. In this way, the need for a water chamber within the base 120 (as was the case with the first embodiment) is avoided. Water may, for example, be delivered via supply line 269 to an inlet port 270 at the intersection of the two diagonal channels 265.

In the first embodiment, a sealing system was associated with each access opening 123 to prevent the ingress of foreign matter into the interior of the body structure. In the first embodiment, the sealing system comprised a seal which slidably and sealingly contacted the outer side 116 of the endless track 115 and which was adapted for movement to accommodate variations in the outer side 116 because of the cleats 117. Specifically, the seal was moveable laterally with respect to the outer side 116 in order to maintain sealing contact therewith while also accommodating the cleats 117. Other arrangements for the sealing system are of course possible. One such arrangement is illustrated in FIGS. 47 and 48 of the drawings.

Figure 47:
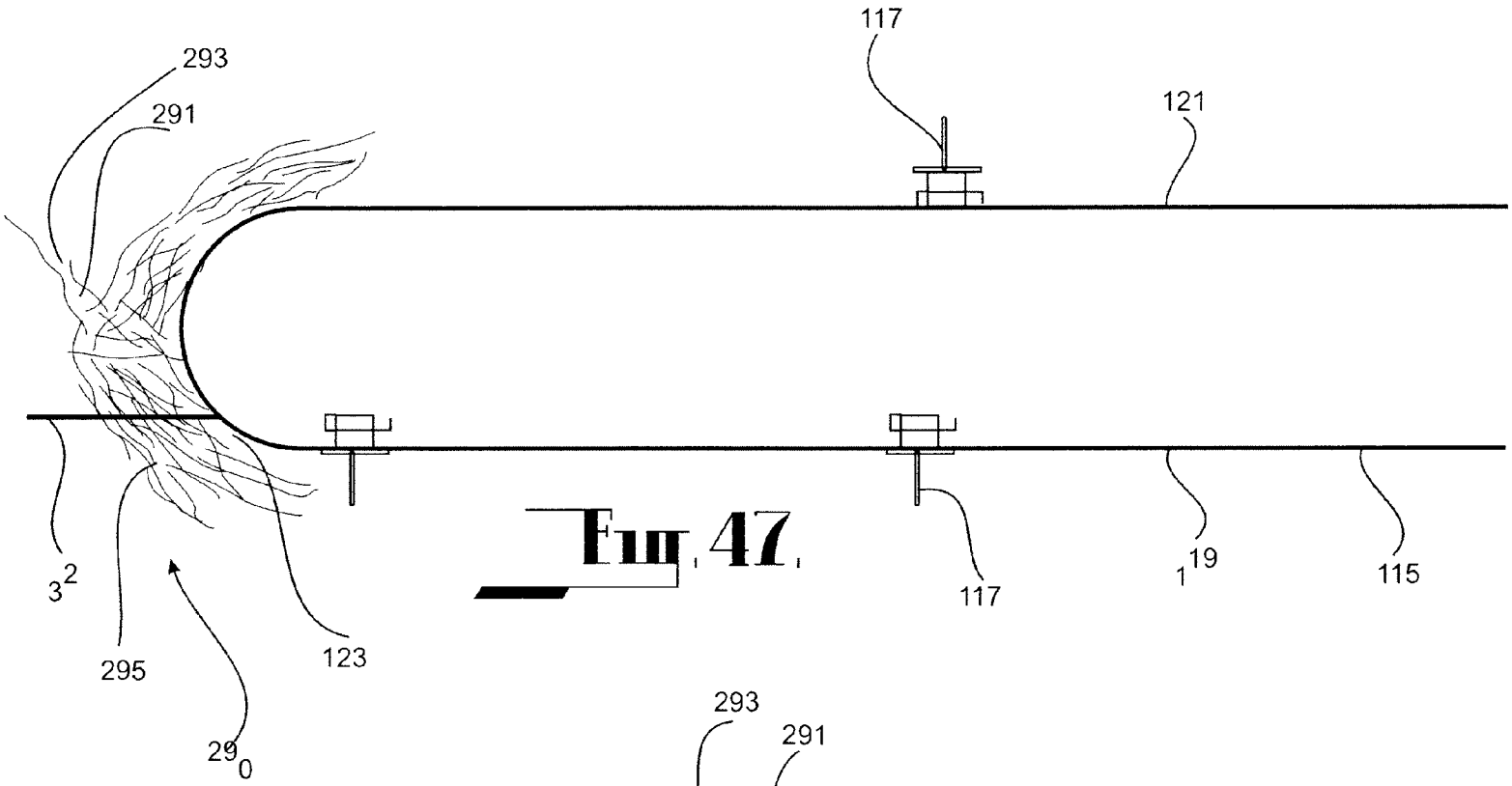
FIG. 47 is a fragmentary side view of apparatus according to a fifth embodiment, illustrating in particular part of a sealing system therefor.
Figure 48:
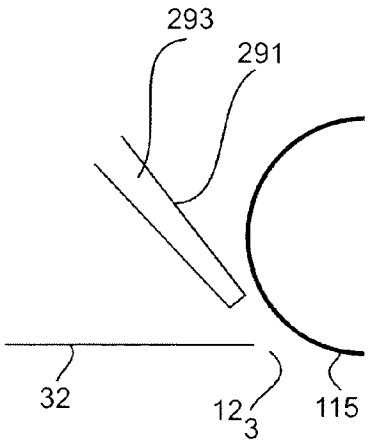
FIG. 48 is a schematic view of the sealing system illustrated in FIG. 47.

Referring now the FIGS. 47 and 48 of the drawings, there is shown a sealing system 290 for apparatus according to a fifth embodiment. The apparatus according to this fifth embodiment is similar to the apparatus according to the first embodiment, apart from the sealing system. In this fifth embodiment, the sealing system 290 comprises means 291 for directing water under pressure outwardly through the opening 123 to prevent ingress of unwanted material such as sand. In the arrangement shown, the means 291 comprises a jet 293 disposed inwardly of the opening 123 and oriented to direct a stream of water 295 under pressure through the opening.

In the first embodiment, the various longitudinal shroud sections 204 turned about roller assemblies 155 prior to being assembled into the shroud 23. Other arrangements are, of course, possible.

Referring now to FIGS. 49 to 55, there is shown a sixth embodiment of the apparatus in which the longitudinal shroud sections 201 turn about roller structures 300.

Figure 49:
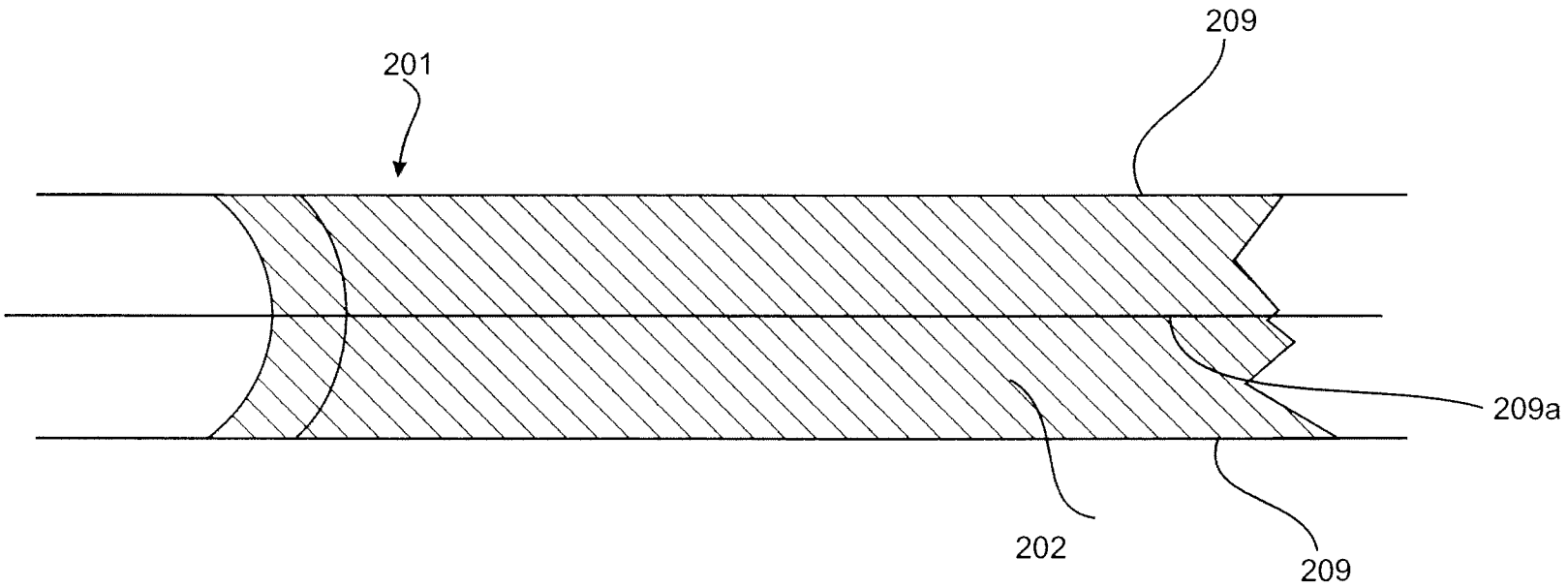
FIG. 49 is a fragmentary view of a longitudinal shroud section utilised in apparatus according to a sixth embodiment.
Figure 50:
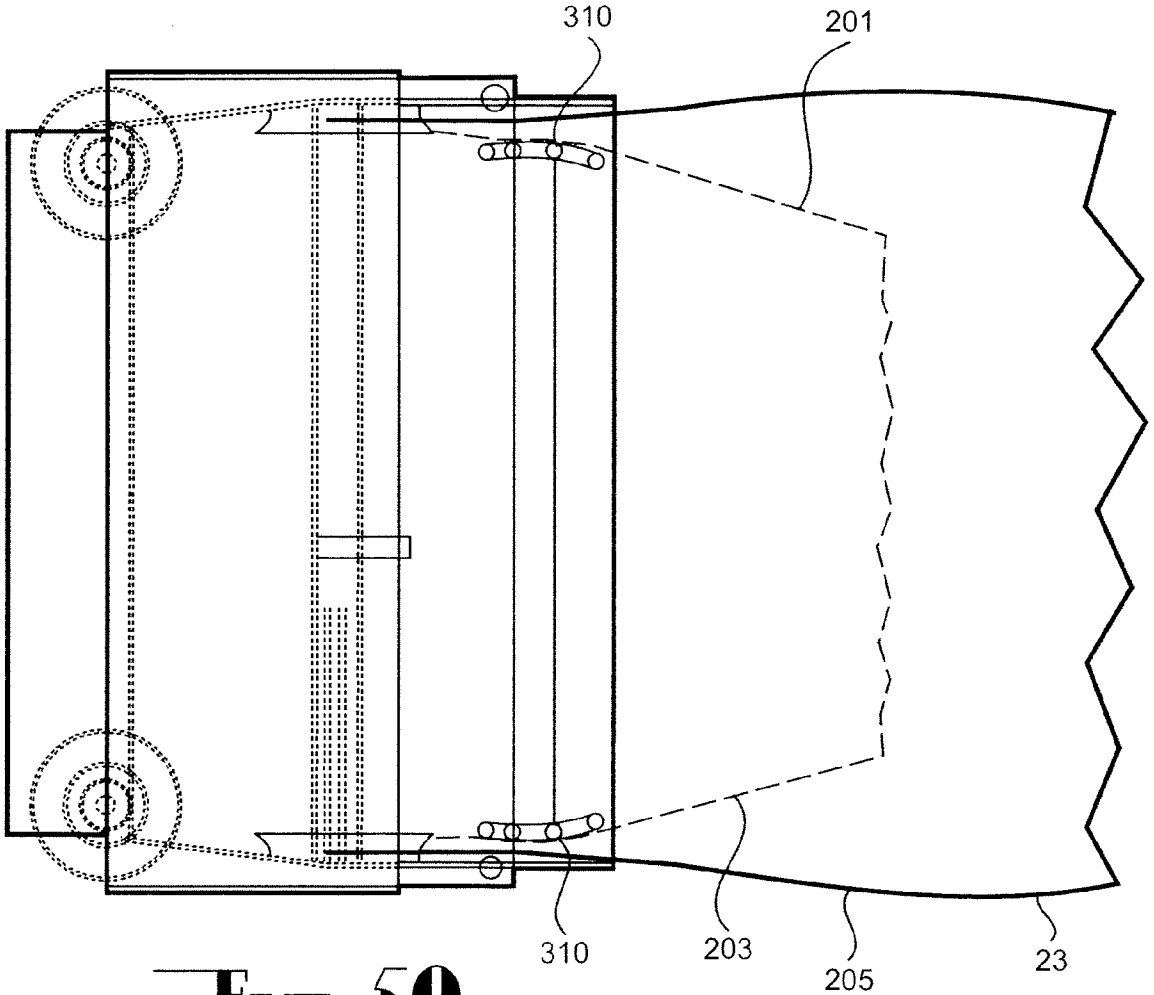
FIG. 50 is a plain view of part of the apparatus according to the sixth embodiment, illustrating in particular a roller structure about which a longitudinal shroud section is turned.
Figure 51:
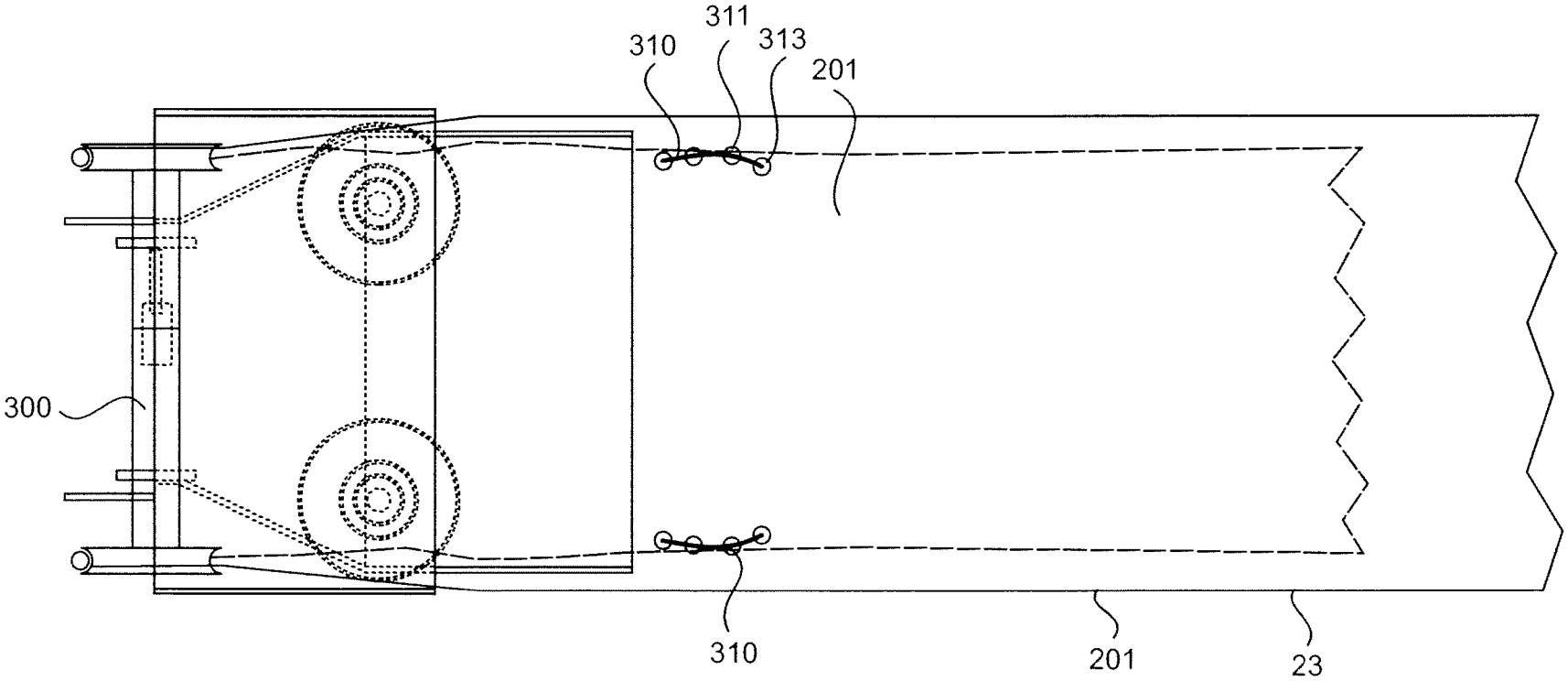
FIG. 51 is a side elevational view of the arrangements shown in FIG. 50.

As can be best seen in FIG. 49, each shroud section 201 comprises a central panel of cloth 202 between the two funicular elements 209. Reinforcing gussets 304 may be provided at intervals along the length of the cloth 202 to transfer loads through the cloth between the funicular elements 209.

Each longitudinal shroud section 201 may also include a central funicular element 209*a*.

Each roller structure 300 comprises two wheels 301 supported on a shaft 303. The shaft 303 is supported on a floating suspension system. Each wheel 301 has an outer periphery 305 configured to guidingly receive a respective one of the funicular elements 209. In the arrangement where the funicular elements 209 comprise cables or ropes, the outer peripheries 303 of the wheels 301 may be configured as rims having grooves in which the funicular elements are received.

Figure 52:
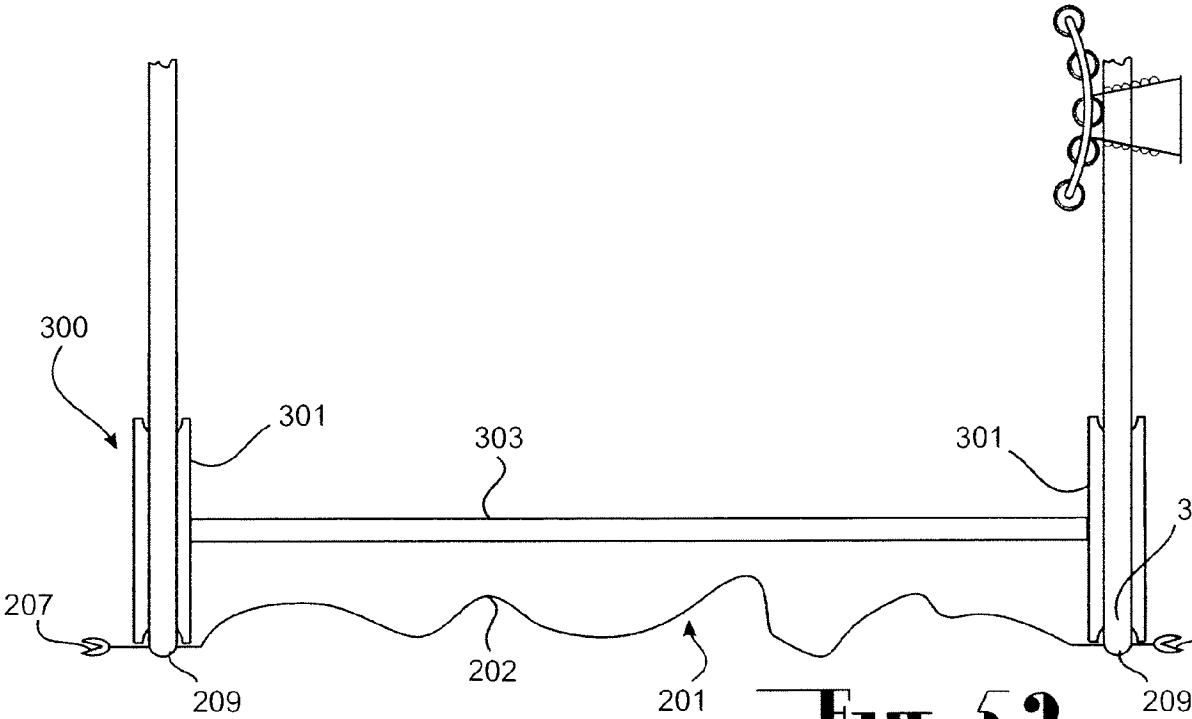
FIG. 52 is a schematic view of the roller structure.

With this arrangement, the flexible cloth 202 between the funicular elements 209 merely extends between the funicular elements as they turn about the wheels 301, as best seen in FIG. 52.

Figure 53:
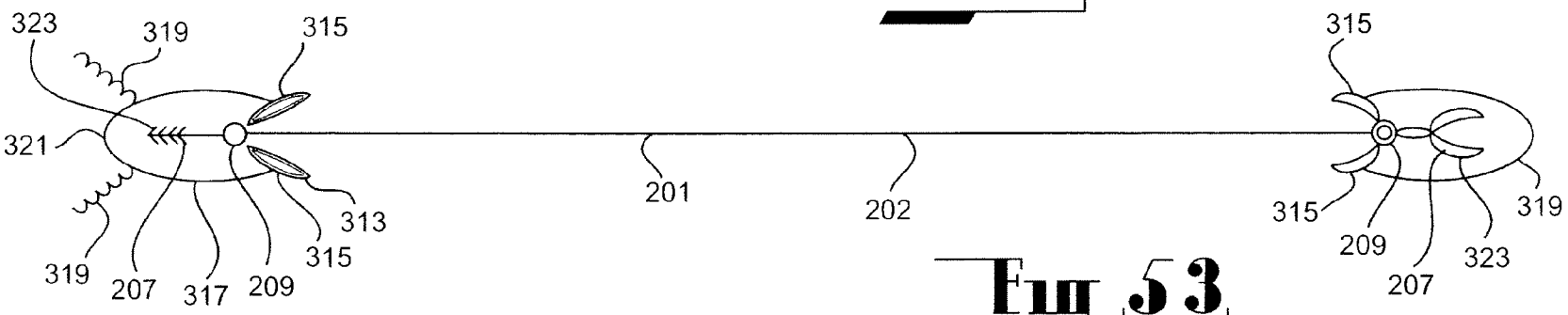
FIG. 53 is a schematic view of a guide structure associated with the roller structure of FIG. 52.

A guide structure 310 is provided for guiding each funicular element 209 towards its respective wheels 301 as the inner portion 203 of the respective shroud section 201 approaches the roller structure 300. In the arrangement shown, each guide structure 310 comprises a roller assembly 311 having at least one set of rollers 313. Preferably, however, there are a series of the roller sets 313 arranged to guide the funicular element 209 towards the respective wheel 301. Each roller set 313 comprises two rollers 315 adapted to engage the respective funicular element 209 on the longitudinally inner side thereof and on opposed sides of the section of flexible cloth 202, as best seen in FIG. 53. Each roller set 313 is mounted on a roller support 317 which is biased to urge the rollers into contact with the funicular element. In the arrangement shown, the roller support is so biased by way of springs 319.

Each roller support 317 comprises a body 321 incorporating a passage 323 through which the connector elements 207 can pass.

After the longitudinal shroud sections 201 turn about the roller structures 300, the outer shroud sections 205 are assembled together to provide the shroud 23 which is guided towards the mandrel 153.

Figure 36:
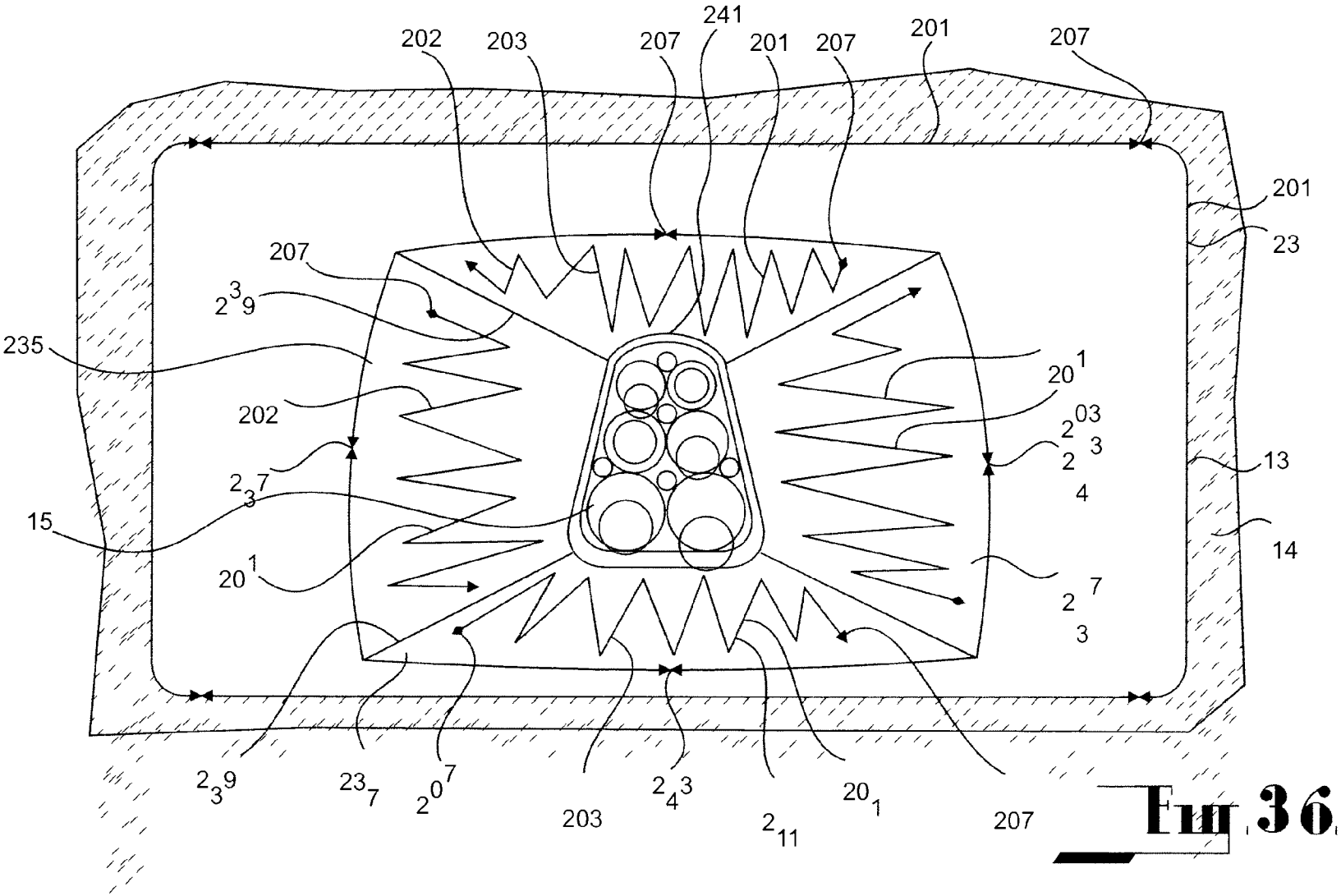
FIG. 36 is a schematic cross sectional view of a supporting shroud in position in a passageway and created by the mining head, and a sock structure into which elongate elements are bundled.
Figure 37:
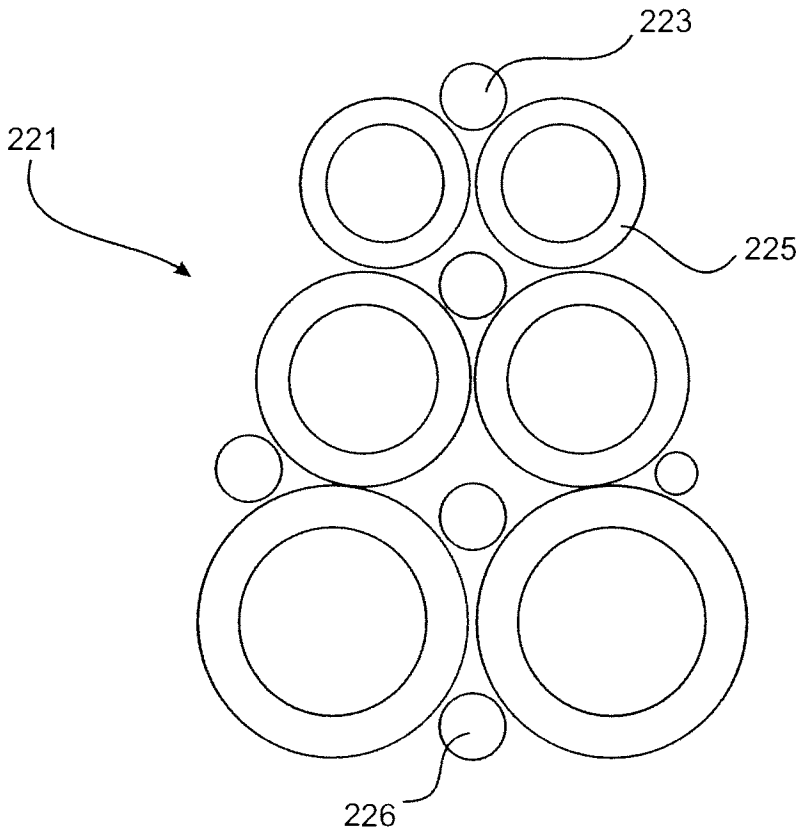
FIG. 37 is a schematic cross sectional view of the elongate elements prior to being bundled in the sock structure.
Figure 38:
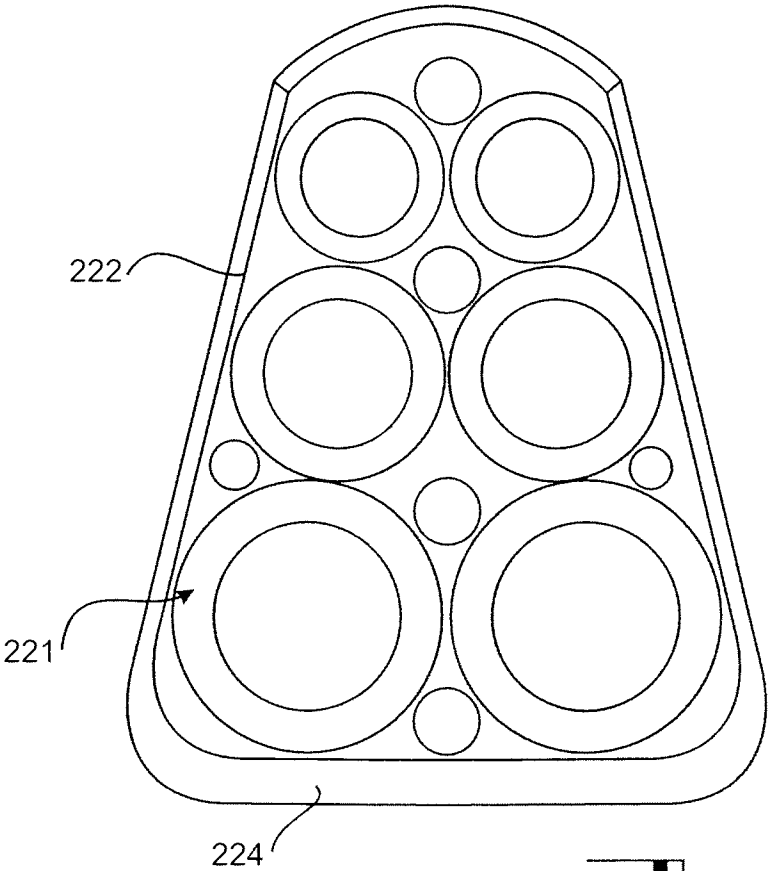
FIG. 38 is a schematic cross sectional view of a cradle clamping the bundle of elongate elements together prior to being positioned in the sock structure.
Figure 39:
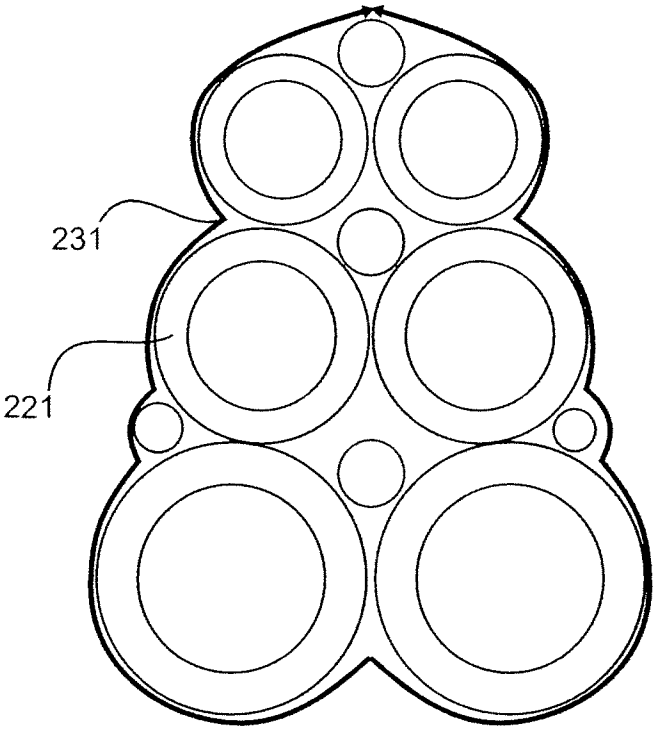
FIG. 39 illustrates a sleave in a tightly wrapped condition about the bundle of elongate elements.
Figure 40:
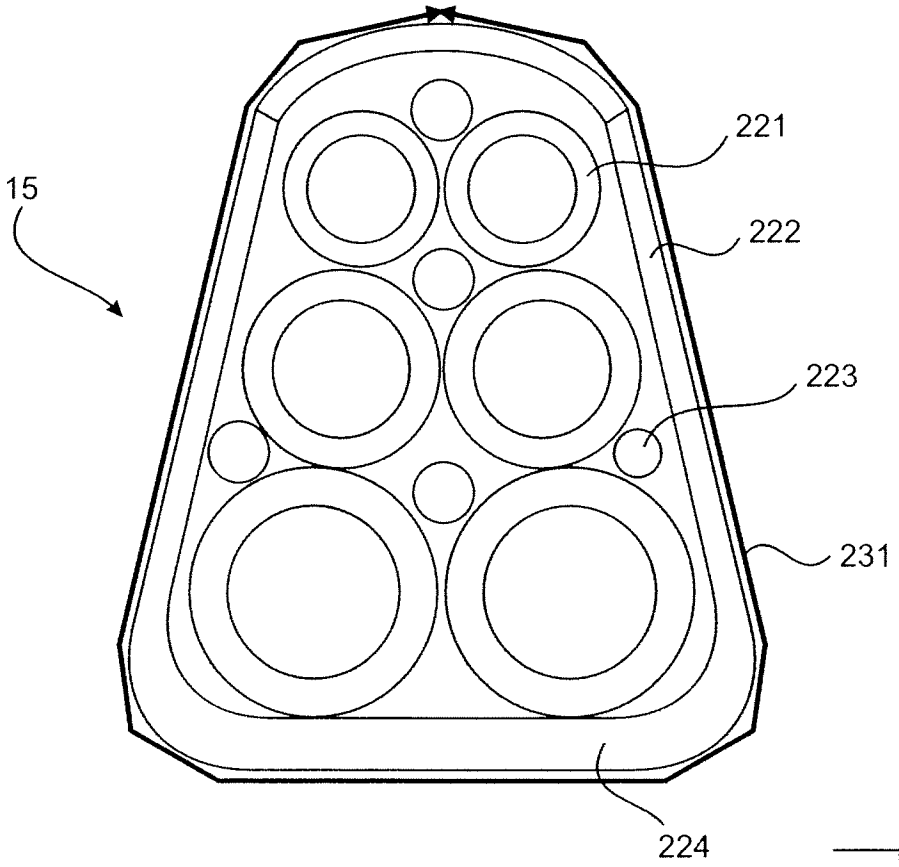
FIG. 40 illustrates the sleave shown in FIG. 39 but at a location corresponding to one of the cradles.

In the first embodiment, the shroud sections 201 were interconnected by the connector elements 207 at the four corners of the generally rectangular shroud 23, as best seen in FIG. 36.

In the arrangement where the shroud sections 201 turn about roller structures 300, the connectors 207 are offset from the four corners, as best seen in FIG. 55. This is to locate the connector elements 207 away from the wheels 301 so that the connector elements do not need engage the wheels 301. This is advantageous, as the connector elements 207 are likely to have less flexibility for passing around the wheels 301 than the funicular elements 209 and the cloth 202 attached thereto. In the arrangement shown, the upper shroud section 201*a* and the lower longitudinal shroud section 201*b* are larger than the longitudinal shroud sections 201*c*, 201*d* at the sides.

Figure 54:
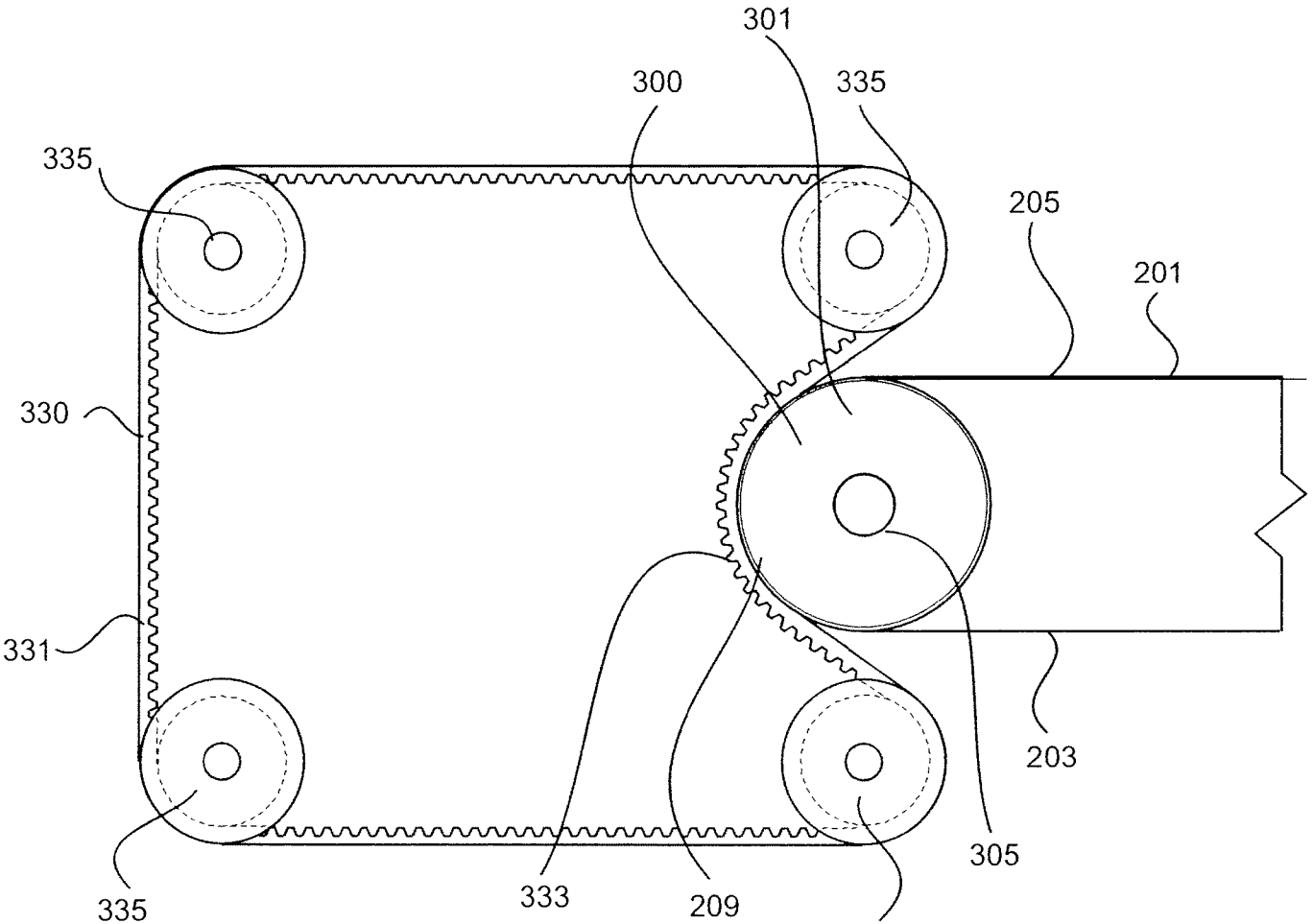
FIG. 54 is a schematic side view of a retaining means used in conjunction with a roller structure of FIG. 52.
Figure 5:
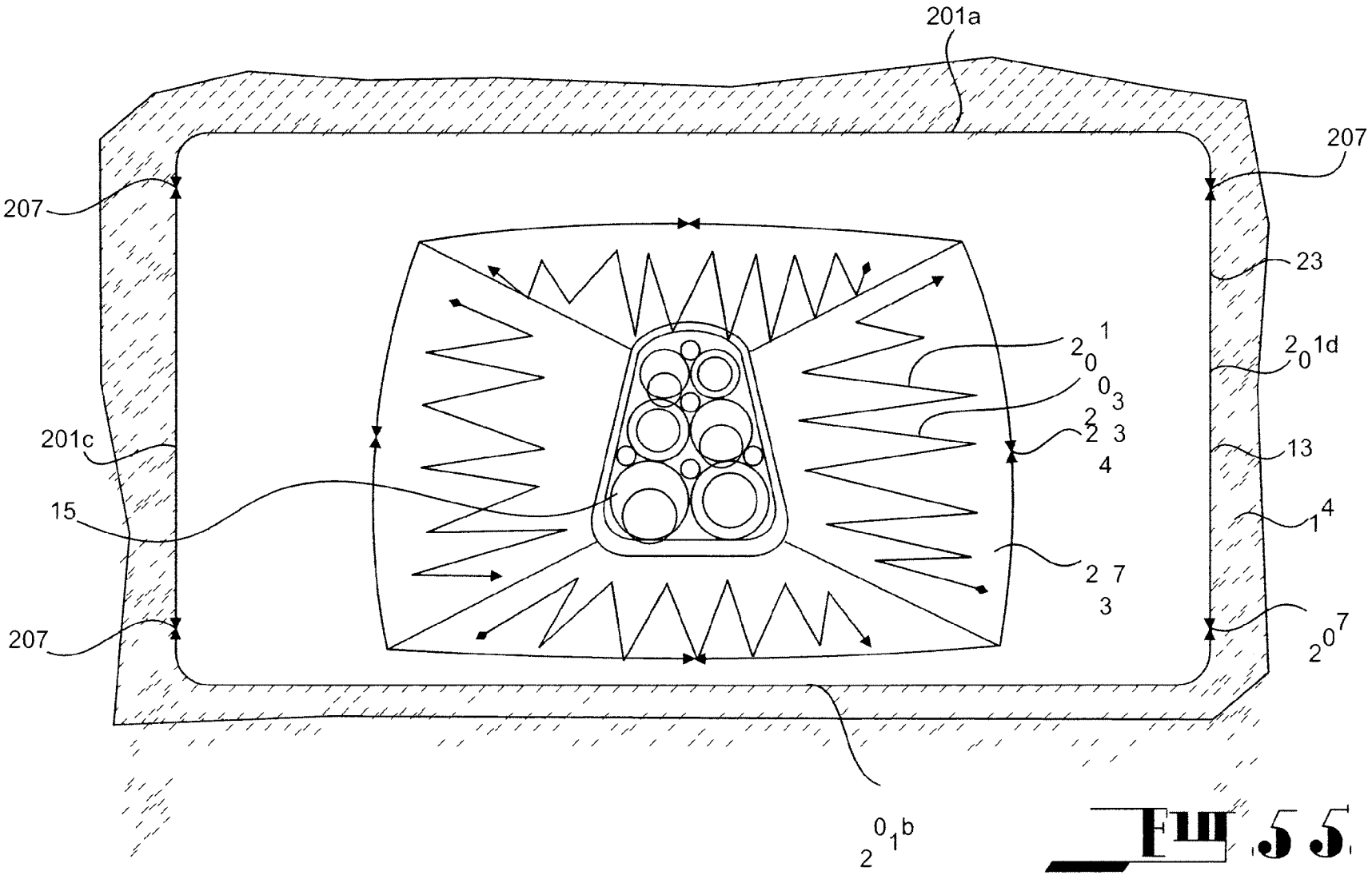

A retaining means 330 is provided for retaining each funicular element 209 within the rims of the wheels 301 as they turn about the wheels. In the arrangement shown, the retaining means 330 comprises an endless belt 331 having a run to 333 which engages against the portion of the funicular element 209 in engagement with the respective wheel 301 and moves in unison therewith, as best seen in FIG. 54. The endless belt 331 passes around rollers 335 so positioned to establish the working run 333 of the endless belt in engagement with the funicular element 209 passing about the respective wheel.

Other arrangements for retaining each funicular element in engagement with its respective wheel 301 while passing therearound are of course possible. One such arrangement may comprise a hook configured to hold the funicular element in place in relation to the wheel.

In the first embodiment, the bottom wall 39 of the mining head 11 incorporated a skid 116 between the sections 115*a*, 115*b* of the endless track 115. The skid 116 included a skid plate 116*b* at the forward end thereof.

In certain situations, there may be some possibility of the skid 116 encountering a hard section of underground material and tending to rise above that hard section of underground material, thereby causing excessive forces to be exerted on the top wall 37 of the mining head. Accordingly, it may be advantageous (in certain applications) to have an arrangement which would allow the skid 116 to cut through material that it might encounter as the mining head 11 advances. Such an arrangement is incorporated in the next embodiment.

Figure 56:
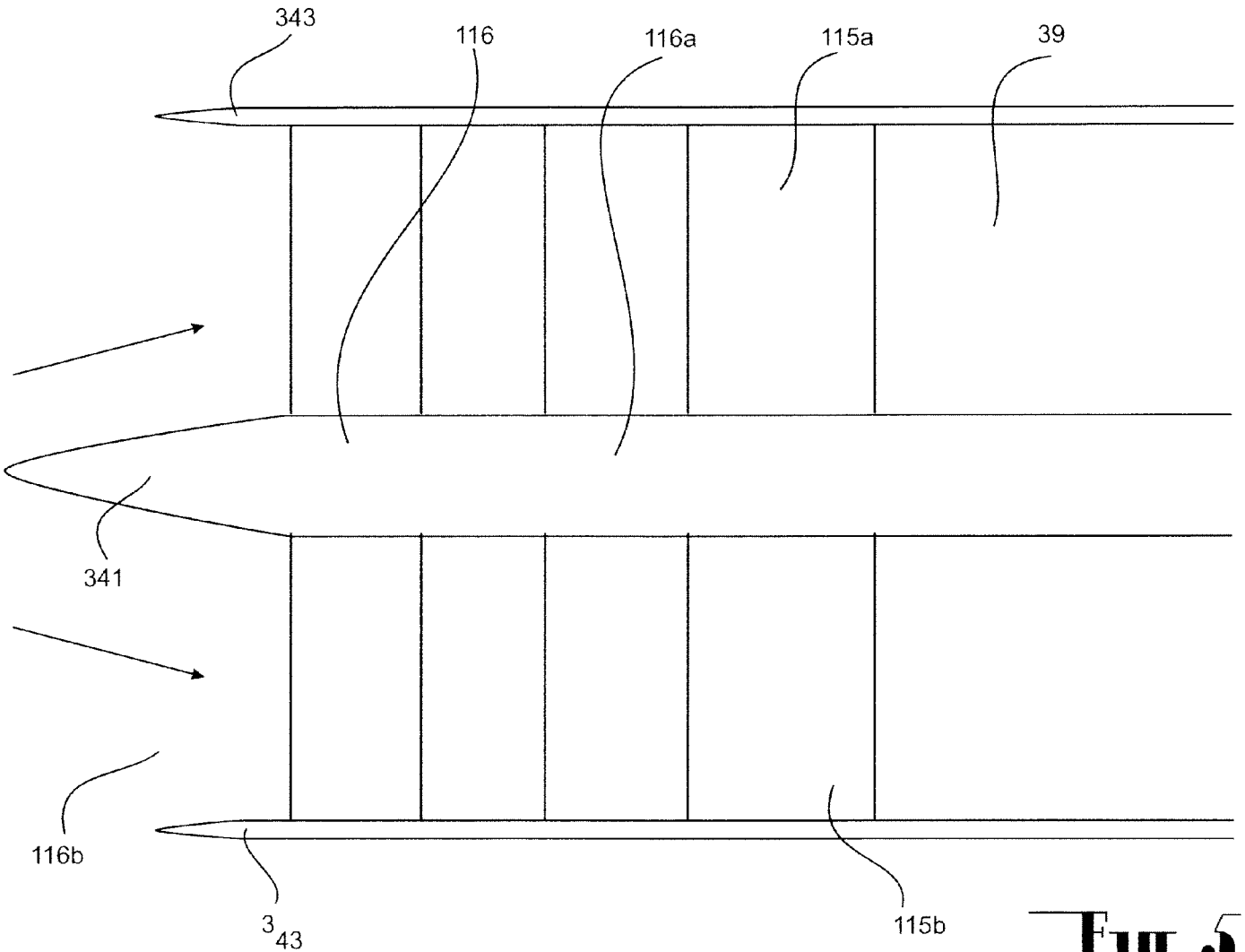
FIG. 56 is a fragmentary schematic view of the under side of a mining head of apparatus according to a seventh embodiment.
Figure 57:
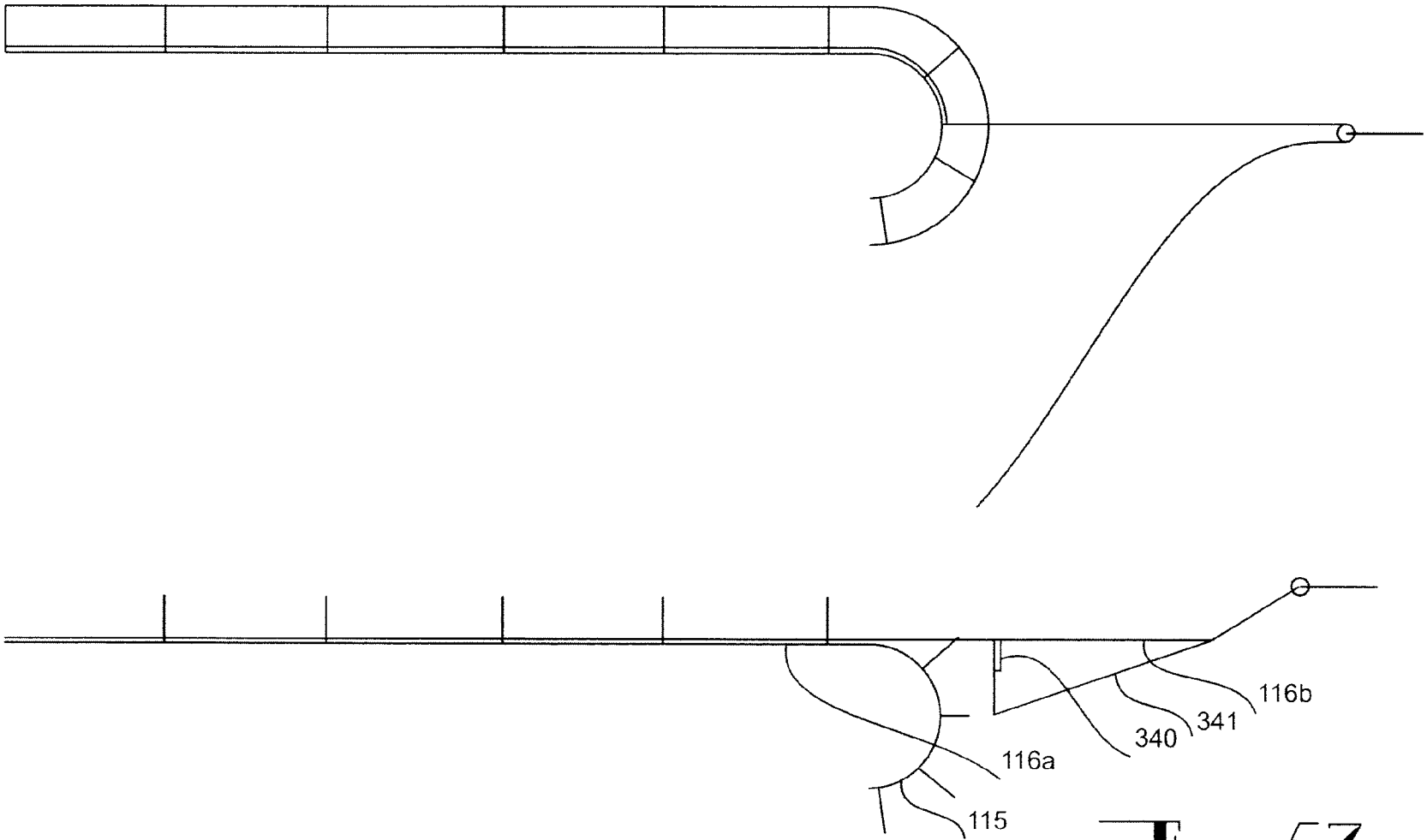
FIG. 57 is a schematic side view of part of the under side illustrated in FIG. 56.

Referring now to FIGS. 56 and 57, there is shown the bottom wall 39 for apparatus according to a seventh embodiment. The apparatus according to this seventh embodiment is similar to the apparatus according to the first embodiment, apart from the construction of the bottom wall 39. In this embodiment, the bottom wall 39 incorporates the skid 116 comprising the central portion 116*a* and the skid plate 116*b*. The skid plate 116 extends upwardly thereby to provide a step 340 at the junction with the central portion 116*a*. A stem 341 is incorporated in the skid plate 116*b* extending forwardly from the central portion 116*a* of the skid. The stem 341 is configured as a cutter for the purposes of cutting into any material that may be encountered as the bottom wall advances with the mining head. With this arrangement, the stem 341 effectively provides a piercing bow which penetrates material and serves to deflect the penetrated material to the track sections 115*a*, 115*b* to each side of the central portion 116*a* of the skid 116.

The skid plate 116*b* also incorporates further stems 343 adjacent to the edges thereof.

In the first embodiment, each endless track 115 comprised an outer side 116 incorporating integral drive cleats 117 for traction. For certain applications, it may be desirable to incorporate an infill panel between the cleats. One such arrangement is provided in the apparatus according to the next embodiment.

Figure 58:
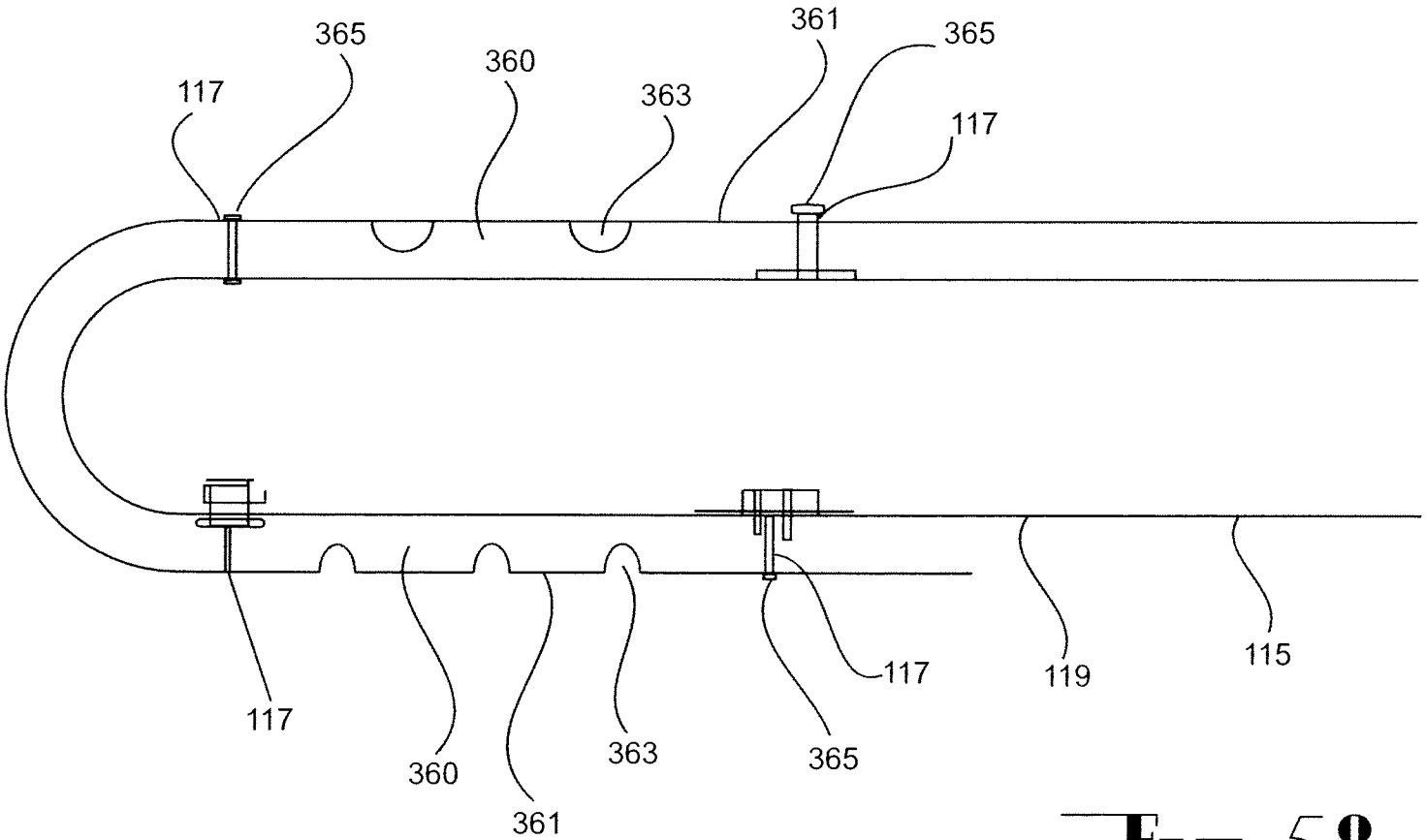
FIG. 58 is a fragmentary elevational view of an endless track of apparatus according to an eighth embodiment.

Referring now to FIG. 58, there is shown a section of an endless track 115 of apparatus according to an eighth embodiment. The apparatus according to this embodiment is similar to the apparatus according to the first embodiment, apart from the presence of an infill panel 360 between the cleats 117. Each infill panel 360 is formed of resiliently flexible material such as rubber and is configured to fit snugly between the cleats 117. Each infill panel 360 has an outer face 361 which locates below the outer edge of the cleats, thereby allowing the cleats to still protrude and provide traction. The outer surface 361 of each infill panel 360 may incorporate a tread formation 363 if desired.

A resilient cap 365 may be provided on the outer end of each cleat 117 if desired.

A particular advantage of the infill panels 360 is that they occupy some of the space between the cleats 117 and therefore reduce space available in which foreign matter can accumulate and be carried towards the access openings 123 in the mining head 11 through which the endless tracks 115 pass.

Improvements and modifications may be made without departing from the scope of the invention.

Throughout the specification, unless the context requires otherwise, the word "comprise" or variations such as "comprises" or "comprising", will be understood to imply the inclusion of a stated integer or group of integers but not the exclusion of any other integer or group of integers.

The claims defining the invention is as follows:

1. An underground working apparatus comprising a working head of a non-circular cross-section in a direction of travel for moving through underground material and forming a non-circular cross-sectional passageway behind the working head as it advances through the underground material, an elongate structure extending through the non-circular cross-sectional passageway to the working head, and means for positioning a shroud assembled from a plurality of longitudinal shroud sections, wherein each of the plurality of longitudinal shroud sections are formed from a compacted longitudinal shroud section about at least a portion of a longitudinal periphery of the elongate structure as the non-circular cross-sectional passageway is formed for supporting engagement with a periphery of the non-circular cross-sectional passageway to support and provide a space corresponding to the non-circular cross-sectional passageway through which the elongate structure can move as the shroud is positioned, the shroud having a cross-sectional shape corresponding generally to a non-circular cross-sectional shape of the non-circular cross-sectional passageway formed by the working head when the shroud is deployed in the non-circular cross-sectional passageway, wherein each of the plurality of shroud sections corresponds to a side of the non-circular cross-sectional passageway when in place, and wherein the supporting engagement of the shroud maintains the non-circular cross-sectional shape of the non-circular cross-sectional passageway and space so that the non-circular cross-sectional passageway does not collapse.

2. An underground working apparatus according to claim 1 wherein the non-circular cross-sectional passageway formed by the working head and the cross-sectional shape of the shroud are generally rectangular.

3. An underground working apparatus according to claim 1 wherein the plurality of longitudinal shroud sections is adapted to be connected one to another at adjacent longitudinal edges.

4. An underground working apparatus according to claim 3 wherein a connection between adjacent longitudinal edges is a sealing connection.

5. An underground working apparatus according to claim 1 wherein the non-circular cross-sectional passageway is of generally rectangular cross-section having four sides and wherein the shroud has four shroud sections.

6. An underground working apparatus according to claim 3 wherein the shroud sections are, in use, each turned around a turning location to provide an inner portion which is moved along the non-circular cross-sectional passageway with the elongate structure, and an outer portion which is turned back with respect to the inner portion and which is assembled into the shroud.

7. An underground working apparatus according to claim 6 further comprising a turn structure defining the turning location.

8. An underground working apparatus according to claim 7 wherein the turn structure is rotatable about an axis transverse to a longitudinal extent of the shroud section.

9. An underground working apparatus according to claim 7 wherein the turn structure presents a tortuous profile for contact with the shroud section turning therearound.

10. An underground working apparatus according to claim 9 wherein the turn structure comprises a plurality of rotatable elements each mounted for rotation about an axis transverse to a direction of travel of the shroud section around the turn structure.

11. An underground working apparatus according to claim 10 wherein the rotatable elements are mounted for rotation on a common base itself rotatable about an axis transverse to the direction of travel of the shroud section.

12. An underground working apparatus according to claim 1 wherein the elongate structure extending from the working head comprises a plurality of elongate elements bundled together in a sock structure.

13. An underground working apparatus according to claim 12 wherein the sock structure includes an inner wall which defines a sleeve within which the bundle of elongate elements are encapsulated, and an outer wall spaced from the inner wall to define a chamber within which the shroud sections are accommodated as they move along the non-circular cross-sectional passageway.

14. An underground working apparatus according to claim 12 wherein the sock structure is progressively fitted onto the elongate structure (i.e. the bundle of elongate elements) as the latter is progressively introduced into the non-circular cross-sectional passageway.

15. An underground working apparatus according to claim 1 wherein the working head comprises a mining head which progressively excavates material from an underground location at which it is operating and conveys the excavated material to a remote location by way of piping in the elongate structure.

16. An underground working apparatus according to claim 15 wherein the mining head comprises a body structure incorporating a casing having an exterior presenting a generally rectangular profile to oncoming material as it advances through the underground location.

17. An underground working apparatus according to claim 16 wherein the exterior comprises a front wall, a top wall, a bottom wall and two side walls.

18. An underground working apparatus according to claim 16 wherein the body structure comprises a rear section forming part of the means for positioning the shroud about at least a portion of the longitudinal periphery of the elongate structure.

19. An underground working apparatus according to claim 17 wherein the body structure comprises a suction chamber to receive slurry material extracted from the underground location.

20. An underground working apparatus according to claim 19 wherein the front wall incorporates a screen through which slurry material can pass to enter the suction chamber, the screen comprising a grizzly having a first side which confronts the oncoming material and an opposing second side, a tine assembly associated with the screen and comprising a plurality of tines supported on a support means comprising one or more endless chains operative to move around end sprockets, and a flushing system for flushing the one or more endless chains to resist ingress of grit.

21. An underground working apparatus according to claim 20 wherein the flushing system establishes a flushing fluid flow across the chain in a direction towards the suction chamber, thereby serving to convey grit in the suction chamber in a direction away from the one or more endless chains.

22. A method of extracting material from an underground location comprising moving a working head of a non-circular cross-section in a direction of travel through the underground material and forming a non-circular cross-sectional passageway behind the working head as it moves through the underground material, providing an elongate structure extending along the non-circular cross-sectional passageway to the working head, positioning a shroud, assembled from a plurality of longitudinal shroud sections that are formed from a compacted longitudinal shroud section, about at least a portion of a longitudinal periphery of the elongate structure as the non-circular cross-sectional passageway is formed for supporting engagement with a periphery of the non-circular cross-sectional passageway to support and provide a space corresponding to the non-circular cross-sectional passageway through which the elongate structure can move as the shroud is positioned, the shroud having a cross-sectional shape corresponding generally to a non-circular cross-sectional shape of the non-circular cross-sectional passageway formed by the working head when the shroud is deployed in the non-circular cross-sectional passageway, wherein each of the plurality of longitudinal shroud sections is positioned against a side of the non-circular cross-sectional passageway so that each of the plurality of shroud sections corresponds to the side of the non-circular cross-sectional passageway when in place, and wherein the supporting engagement of the shroud maintains the non-circular cross-sectional shape of the non-circular cross-sectional passageway and space so that the non-circular cross-sectional passageway does not collapse.

* * * * *